US007954307B2

(12) United States Patent
Paunesku et al.

(10) Patent No.: US 7,954,307 B2
(45) Date of Patent: Jun. 7, 2011

(54) ADJUSTABLE POUCH FORMING, FILLING AND SEALING APPARATUS AND METHODS

(75) Inventors: Sima Paunesku, Cincinnati, OH (US); Daniel J. Rack, Cincinnati, OH (US); Jeffrey D. Wintring, Florence, KY (US); Richard A. Roth, Cincinnati, OH (US)

(73) Assignee: R. A. Jones & Co. Inc., Covington, KY (US)

( * ) Notice: Subject to any disclaimer, the term of this patent is extended or adjusted under 35 U.S.C. 154(b) by 0 days.

(21) Appl. No.: 11/668,205

(22) Filed: Jan. 29, 2007

(65) Prior Publication Data

US 2007/0180794 A1 Aug. 9, 2007

Related U.S. Application Data

(60) Provisional application No. 60/763,940, filed on Jan. 31, 2006.

(51) Int. Cl.
*B65B 43/46* (2006.01)
*B65B 43/60* (2006.01)

(52) U.S. Cl. ..... 53/459; 53/469; 53/570; 53/284.7

(58) Field of Classification Search ..... 53/459, 53/469, 570, 284.7, 468, 384.1, 571, 385.1; 141/10, 114, 166, 313; *B65B 43/28, 43/30, B65B 43/32, 43/46, 43/50, 43/60*
See application file for complete search history.

(56) References Cited

U.S. PATENT DOCUMENTS 2,054,279 A * 9/1936 Briggs ..... 53/384.1
2,269,532 A * 1/1942 Howard ..... 53/570
3,323,280 A * 6/1967 Rausch ..... 53/571
3,340,679 A * 9/1967 Johnson ..... 53/385.1
3,369,577 A * 2/1968 Johnson et al. ..... 141/166
3,381,446 A * 5/1968 Marchand ..... 53/385.1
3,382,644 A * 5/1968 Vogt ..... 53/455
3,563,001 A 2/1971 Cloud
3,597,898 A 8/1971 Cloud
3,812,649 A * 5/1974 Clancy ..... 53/385.1
3,821,873 A 7/1974 Benner, Jr. et al.
3,822,008 A 7/1974 Benner, Jr. et al.
3,851,751 A 12/1974 Jones
4,232,504 A 11/1980 Dieterlen et al.
4,344,269 A 8/1982 Dieterlen et al.
4,353,198 A * 10/1982 Koppe ..... 53/570

(Continued)

FOREIGN PATENT DOCUMENTS

CA 2142480 8/1995

(Continued)

*Primary Examiner* — Stephen F Gerrity

(74) *Attorney, Agent, or Firm* — Wood, Herron & Evans, LLP

(57) ABSTRACT

An adjustable pouch machine comprises a vertical sealer module forms transverse seals between two plies of a pouch web to partially define a plurality of pouches. Rollers selectively tension and relax the web on the vertically oriented wheel, allowing them to drop away from heated lands on emergency and cycle stops. A filler wheel has a plurality of adjustable gripper units mounted directly thereon for transporting independent separate pouches cut from the pouch web. An adjustable knife is selectively provided with changeable knife hub sets to handle a variety of pouch sizes where a filler wheel alternately first fills and seals pouches in a train. Gear linkage accommodates variation in distance between hubs of different sets. Various embodiments, apparatus and methods are described.

13 Claims, 18 Drawing Sheets

U.S. PATENT DOCUMENTS

| | | | | | |
|---|---|---|---|---|---|
| 4,509,313 | A | * | 4/1985 | Koppe | 53/570 |
| 4,517,788 | A | * | 5/1985 | Scheffers | 53/459 |
| 4,534,158 | A | | 8/1985 | McClosky | |
| 4,872,382 | A | | 10/1989 | Benner, Jr. et al. | |
| 4,956,964 | A | | 9/1990 | Jones et al. | |
| 5,222,422 | A | * | 6/1993 | Benner et al. | 83/37 |
| 5,315,807 | A | * | 5/1994 | Restle et al. | 53/51 |
| 5,320,146 | A | * | 6/1994 | Stevie | 141/114 |
| 5,502,951 | A | | 4/1996 | Oliverio | |
| 5,575,187 | A | | 11/1996 | Dieterlen | |
| 5,605,183 | A | * | 2/1997 | Hartman et al. | 141/237 |
| 5,687,551 | A | * | 11/1997 | Mustain et al. | 53/468 |
| 5,829,332 | A | | 11/1998 | Dieterlen | |
| 5,845,466 | A | * | 12/1998 | Laudenberg | 53/568 |
| 6,058,818 | A | | 5/2000 | Dieterlen | |
| 6,119,440 | A | | 9/2000 | Benner | |
| 6,199,351 | B1 | * | 3/2001 | Mount | 53/563 |
| 6,212,859 | B1 | * | 4/2001 | Bielik et al. | 53/562 |
| 6,276,117 | B1 | * | 8/2001 | Wiles | 53/570 |
| 6,393,809 | B2 | * | 5/2002 | Todd et al. | 53/562 |
| 6,553,743 | B1 | | 4/2003 | Makutonin | |
| 6,657,165 | B1 | | 12/2003 | Makutonin | |
| 6,745,540 | B2 | * | 6/2004 | Hiramoto et al. | 53/133.2 |
| 6,823,647 | B2 | * | 11/2004 | Kinigakis et al. | 53/133.4 |
| 6,917,014 | B2 | | 7/2005 | Makutonin | |
| 7,021,036 | B2 | * | 4/2006 | Hiramoto et al. | 53/562 |
| 2001/0015056 | A1 | * | 8/2001 | Hiramoto et al. | 53/479 |
| 2004/0025476 | A1 | * | 2/2004 | Oliverio et al. | 53/450 |
| 2005/0229550 | A1 | * | 10/2005 | Eder | 53/571 |

FOREIGN PATENT DOCUMENTS

| | | | | |
|---|---|---|---|---|
| EP | 908387 | A1 | * | 4/1999 |
| JP | 01084827 | A | * | 3/1989 |
| JP | 11292001 | | | 10/1999 |
| JP | 2005015063 | A | * | 1/2005 |

* cited by examiner

ADJUSTABLE POUCH FORMING, FILLING AND SEALING APPARATUS AND METHODS

PRIORITY CLAIM

Applicant claims the benefit of the filing date of the U.S. provisional patent application Ser. No. 60/763,940 by the same title, filed on Jan. 31, 2006.

FIELD OF THE INVENTION

This invention relates to pouch forming, pouch filling and pouch sealing. More particularly, this invention relates to apparatus and methods for performing these operations for a wide range of pouch sizes in an adjustable pouch machine.

BACKGROUND OF THE INVENTION

In the past, pouches have been formed, filled and sealed in a variety of ways. Some prior devices operated on an intermittent basis, which is not generally conducive to efficiency where pouches must be formed, filled and sealed at higher rates than intermittent motion machines can effectively produce.

In one prior continuous operation, such as illustrated in U.S. Pat. No. 3,821,873, expressly incorporated herein by reference as if fully set out herein, pouches are formed by folding a pouch web lengthwise, creating transverse seals across the folded web to form a series of pouches in a pouch train by running the folded web around a horizontally disposed wheel where spaced heated sealing lands seal the web together, transporting the web train around a filler wheel, filling pouches as the train is moved around the filler, sealing the open pouch tops, then cutting pouches from the train at pouch edges defined by the cut lines along the transverse seal areas. Such pouch forming, filling and sealing equipment is very efficient and operates at relatively high speeds compared to an intermittent pouch operation.

While such equipment works well for pouches of a given pitch or width, use of the same equipment to form, fill and seal pouches of significantly different widths requires a significant number of major change parts. For example, the entire web sealer wheel and entire filler wheel structure must typically be changed out.

See, for example, the pouch machine disclosed in U.S. Pat. No. 5,502,951, which is expressly incorporated herein by reference. That machine handles a degree of pouch width variations by use of coordinated sealer wheel and filler wheel change parts, whose drives are mechanically linked in cooperation. The number of pouch stations on the sealer must be associated in whole number relation to those on the filler wheel about which the pouch train is engaged on vacuum lands.

In this application, the phrase "pouch width" is used to refer to that distance from one vertical pouch edge to the opposite vertical edge of the same pouch when the pouches are oriented with their mouths above their folded bottom and the edges extend between the mouths and the bottom on both sides of the pouch. The "width" is typically extended in the same direction the pouches move through the pouch forming sealers and pouch fillers.

The term "pitch" generally refers to the distance from one point of a pouch to the identical point on an immediately preceding or succeeding pouch. Thus, pouch "pitch" might be, for example, that distance from a leading edge of one pouch to the same leading edge of an immediately following pouch, however it is transported.

The phrase "pitch line" is used to identify the line or path that pouches follow through the process.

As used herein, the terms "wheel" and "filler wheel" refer to any wheel-like or annular structure operable as described herein and including but not limited to a solid, circular disk, or annulus or ring, or other shaped configuration or structure capable of carrying the gripper units or pouch supporting lands as described herein about or through a curved or circular pouch pitch line or path for filling, and through a variety of stages or sectors as described herein.

In other prior U.S. Pat. Nos. 6,657,165 and 6,917,014, a horizontally oriented sealer wheel is provided with heated sealing lands which have slight radial adjustments to permit some adjustment between the parallel transverse seals, but the adjustment provided is insufficient to provide the extent of pouch width size adjustment now desired in the industry, such as for pouches ranging from about 2.5 inches to about 5.5 inches in major width. Major change parts are required and the changeover procedures are time consuming, but necessary for a pouch operation with the capacity to handle a wide range of pouch widths.

It is now desired in the industry to have equipment capable of continuously forming, filling and sealing pouches having widths varying in different pouch runs from about 2.5 inches width (seal-to-seal) to about 5.5 inches width, and at high speeds up to about 500 pouches per minute on the sealer wheel. And at the filler wheel, depending on the pitch or number of stations around the circumference of a given filler wheel, throughput speeds of up to 3750 inches per minute (at the pouch path) are desired. While prior apparatus has provided some degree of adjustability, for slighter pouch width variations than noted above, there is no known equipment capable of handling pouches at high speed and in the now desired width range without significant changeover parts, time and cost.

In another aspect of such pouch operations, consideration must be given to the handling of the pouch web on the sealer wheel.

In the typical prior operation, the folded web is disposed horizontally around a horizontally disposed sealer wheel on a vertical axis and having a plurality of spaced heated sealing lands against which the web is tensioned. Such wheels and lands are constructed so that traverse seals are created across the web plies from the bottom web fold line to the open top edges of the plies. Such sealer wheels work well in continuous operation but accommodation must be made for operational or "cycle stops" where the process and the web must be stopped momentarily, or for an extensive time. Heat from the lands transfers into the stopped web at the seals and the seal propagation in the web at the seals can unduly widen the seals or the excessive heat transfer due to extended dwell time can even burn through the web, breaking the web on the wheel or otherwise rendering pouches on the wheel unusable on system start. In the past, such sealers have sometimes been referred to as "vertical sealers", but this refers to the orientation of the seal in the pouch web sides when the folded web is vertically oriented, and not to the orientation of the sealer wheel itself, which is typically horizontal, rotating about a vertical axis.

It is thus desirable to provide a continuous web sealer where, nevertheless, undue heat transfer and seal propagation on cycle stops is eliminated.

In another typical system for forming, filling and sealing pouches, the pouches are cut apart from the pouch train before filling. Such apparatus is clearly described and shown in U.S. Pat. No. 4,956,964 which is expressly incorporated herein by reference as if fully expressly set forth herein. These pouches are delivered to a pair of pouch gripping jaws carried on a carrier chain. The leading edge or seal of the pouch is gripped by a leading gripper jaw of the jaw pair, while the trailing pouch edge or seal is gripped by a trailing gripper jaw, generally at a distance below the open pouch mouth which is directed upwardly. These jaws are relatively movable with respect to each other to allow the pouch to be opened and filled. The individual pouches are then sealed and discharged.

In this system, the gripper jaws are carried by chains drawn around respective sprockets. These require maintenance and are somewhat noisy compared to systems where the uncut pouch train engages with filler wheel lands and is filled about a filler wheel which had no chains, sprockets or grippers.

It will thus be appreciated that systems for handling a wide range of pouch widths or pitch in the now desired range of about 2.5 to 5.5 inches and at effective pouch machine speeds up to about 3750 inches per minute must take into account numerous pouch handling functions of filling, sealing and cutting. Sealing apparatus must be capable of producing final pouch seals in the pouch web for the extremes of pouch sizes and provision must be made to eliminate seal propagation, burn through or heat caused pouch destruction during cycle stops, similar to those issues in the pouch forming process. Moreover, provisions must be made to accommodate the varied pouch width extremes on the filler wheel, and provisions must be made for accurately cutting pouch after pouch from either the formed or filled web within the seal areas. All this must be accomplished on a continuous basis with as little pouch rejection as possible, for the noted wide range of possible pouch widths. The cost of obtaining a plurality of machines, each to handle a single pouch size, even if slightly variable by adjustment within a very narrow range, is prohibitively expensive, and at the least takes up too much production floor space.

In another consideration of pouching operations, there is a concern of cleanliness resulting from stray product. Frequently, the product loaded into the pouches is a powder, fine particles or a frangible product. Stray product contaminates pouching apparatus and requires frequent wash down or cleaning. Where the pouch apparatus is fully integrated, cleaning of the filling area where pouches are filled and most likely to have stray product involves or intrudes into other components of the equipment, whether cleaning is needed there or not.

It has been one objective of the invention to provide an improved pouch forming, filling and sealing apparatus and methods capable of handling a wide range of pouch widths at high speed.

A further objective of one embodiment of the invention has been to provide apparatus and methods for forming, filling and sealing pouches in a wide range of pouch widths while requiring only minimal, if any, change parts.

A further objective of the invention has been to provide apparatus and methods for producing transverse seals in a folded pouch web and which does not conduct destructive or excessive heat into the web on cycle stops, such that undue heat or seal propagation into the web is eliminated.

A further objective of the invention in an alternate embodiment is to provide apparatus and methods for forming, filling and sealing pouches in a wide range of pouch widths wherein change parts are used in sub assemblies smaller, lighter, easier to handle and more repeatable than prior devices requiring more major and potentially more expensive change parts.

A further objective of one embodiment of the invention has been to provide a rotary knife apparatus wherein the hubs can be changed to accommodate pouch width changes in a wide range, but without excessive drive lash in the hub drives.

A further objective of one embodiment of the invention has been to provide an improved pouch forming, filling and sealing apparatus in combination with a rotary knife for accommodating a wide range of pouch widths but without mechanical adjustment or replacement of major and minor knife hubs.

SUMMARY OF THE INVENTION

To these ends, the invention in one aspect contemplates a pouch forming, filling and sealing operation accomplished through a plurality of separable modules, at least one for pouch forming and one for pouch filling and sealing. The two major modules can be spaced apart providing for wash down of the filling apparatus without involving the forming apparatus. Alternately, the two modules can be attached together, depending on the user's desire. Operations of the web forming or sealing module and the respective pouch filling and sealing module are independently controlled. But the modules cooperate to handle a wide range of pouch width configurations.

In one embodiment, for example, a web is folded upon itself and is transversely sealed continuously on a single size but adjustable vertically oriented sealer wheel mounted on a generally horizontal axis. The wheel carries adjustable, horizontally mounted heat bars. The vertical sealer wheel is preferably operated, when used with the filler described herein, at a speed to feed the filler wheel with the proper number of selected pouch configurations at the throughput speeds desired.

After sealing, the transversely sealed web is then turned vertically with the mouth between the seals opening at the top or upwardly. The web is then cut into individual pouches by a rotary knife and fed into gripper units mounted not on a chain but on an endless filler wheel or turret wheel. Each gripper unit has a fixed leading jaw and a movable trailing jaw gripping the leading and trailing edges of the pouches, respectively. To open a mounted pouch for filling, the trailing jaw is moved slightly toward the fixed jaw by one or more cams and held in position by friction. Each opened pouch is carried by a gripper unit on the filler wheel in a circular path and under a filler spout wheel unit where the pouch is filled as it moves through a filling arc or sector of the wheel rotation. Thereafter, a cam causes the gripper jaws to spread slightly apart (the trailing jaw moves away from the leading jaw, for example, in one embodiment, by pivoting around a horizontal axis or by sliding), stretching the mouth of the pouch closed. The pouch top or mouth is sealed in a heat sealer located in this embodiment under the spout wheel of the filler unit. Full and sealed pouched are discharged from their vertical to a horizontal position by a discharge wheel to be described. Other suitable discharge apparatus could be used.

In one alternative embodiment, the pouch gripper jaws are modified and are pivoted on vertical pivot axes perpendicular to the filler wheel, providing a robust gripper structure adjustable for a wide range of pouch widths.

In addition to the foregoing, it will be appreciated that modifications to the invention described above are contemplated, providing alternative embodiments of varied features of the invention.

The present invention provides a pouch machine which is adjustable to run pouches over a wide range of widths in a continuous rotary wheel style motion at high speed and without the aid of any chains, chain tracks or sprockets, which increases productivity and reliability.

One objective of providing an improved adjustable pouch machine is attained in part by providing a single size vertically oriented sealer wheel mounted on a horizontal axis with horizontally disposed, radially adjustable seal bars or lands capable of heating web plies for sealing. Web entry and exit idler rollers slide respectively toward and away from the sealer wheel at web entry and exit points proximate the wheel and at a level above the horizontal rotational axis. This movement relaxes the web tension across hot seal bars during cycle stop, sufficiently to allow the web to sag away from the heated lands or bars to a distance to inhibit unwanted heat or seal propagation in the web. As the rollers are withdrawn away from the wheel, the web sags downwardly, even away from the vertical sealer wheel and the heated lands. Relaxing the web tension against hot seal bars stops undue heat transfer and seal propagation into the web and the pouch fill areas. Moreover, horizontal seal land or bar mounting on a vertical wheel dramatically improves web initial threading.

An adjustable capacity pouch machine is further attained in part by directly mounting gripper units on a filler wheel, each gripper unit having two jaws, between which each separate pouch is carried, the plurality of gripper units being mounted on the endless filler wheel in a uniformly-spaced relationship, but with no carrying chains or sprockets. In the gripper unit of the present invention, the leading jaw is fixed and the trailing jaw is movable. The jaws may be maintained parallel to each other regardless of the amount of separation between them. The trailing jaw in one embodiment is slidably mounted on linear ways and is frictionally retained in the position to which it is slid on the linear ways. The trailing jaw has two actuators or cam followers pivoted on the gripper frame. The leading actuator, when engaged by an upwardly-inclined cam, causes the trailing jaw to retract. When the trailing actuator cam follower rides upwardly upon an associated cam, the trailing jaw advances toward the fixed jaw. The apparatus provides as many cams as are needed for the complete sequence of operations, all cam ramps being respectively identical for actuating each jaw of each unit respectively. In the preferred embodiment of the invention, the sequence of operations includes the following.

With the jaws open wider than the width of a separate pouch, the pouch is brought up to the leading jaw from a rotary cutoff knife by a traditional vacuum belt at a velocity slightly greater than the velocity of the gripper unit so that the pouch buckles slightly as it engages the leading jaw. A cam engages the trailing jaw actuator and advances it to grasp the trailing edge of the slightly buckled pouch. Gripping and release action of the jaws is also cam initiated.

The mode by which the separate pouches are transferred between a cut-off knife and the grippers may be like that described in U.S. Pat. No. 4,956,964, incorporated herein by reference, or may be any other suitable transfer mechanism.

As the pouch is carried about the filler path defined in part by the filler wheel, it moves through an opener section, such as an air flow area (as in U.S. Pat. No. 3,821,873 or any other suitable opener). The trailing jaw actuator engages another cam to advance the trailing jaw slightly to a position for full opening of the pouch while air is blown across the face of the pouch to open it. The jaws frictionally remain in this attitude through the filling operation, where product passes through spouts carried by the spout wheel into the open pouch tops. After the filling operation, the trailing jaw is retracted slightly to stretch the top or mouth of the pouch taut while it is carried through a pouch top sealer of any suitable form and construction.

After being sealed, the pouches are discharged, in one embodiment on a discharge wheel and the trailing jaw is further retracted or reset by a final cam for introduction of a new pouch to be filled.

Each cam is preferably adjustable horizontally in a rotary movement to adjust the timing of the occurrence of jaw movement and adjustable vertically to determine the amount of jaw movement. The adjustments are preferably done with hand knobs and digital counters so that settings can be made and obtained repeatedly for the various pouch sizes. Such gripper units may be like those described in U.S. Pat. No. 4,956,964, or of other suitable construction as described.

In an alternate form of a gripper unit, for example, the trailing jaw and its pivot can be mounted without sliders, but on an adjustable plate which can be adjusted relative to the leading jaw to accommodate a wide range of pouch widths.

In another aspect of the invention, the trailing jaw is simply rotated a greater degree toward the leading jaw for smaller width pouches, and a lesser degree for wider pouches, over a wide pouch range. While the trailing jaw for a smaller width pouch may thus engage the trailing seal edge of the pouch at a point lower than its engagement for a wider pouch, the difference is not so significant as to require a pivot adjustment for a desired range of pouch widths.

Also, a parallel linkage system may be used to retain the trailing edge jaws parallel to the leading jaws if needed.

Accordingly, in this embodiment of the invention, pouches are formed on a vertically disposed sealer wheel, cut off from the web, individually introduced to a gripper unit mounted on a filler wheel and filled and sealed while on that wheel prior to discharge.

In order to cut the pouches prior to their introduction to the gripper units on the filler wheel, a rotary knife is provided which can accommodate pouch cut off widths through a wide range and at the speed required to produce a cut pouch to each gripper unit of the continuously moving filler wheel. More particularly, such a preferable knife comprises a stationary anvil and a rotatable hub or spindle carrying at least one multiple edge blade timed to cooperate and shear pouches from the pouch train provided by the vertical sealer wheel as described at the transverse seals. Other knife configurations can be used. The rotational speed of the hub or hubs of the other knives are adjusted through servos and controls to precisely cut pouches of widely varying widths at the seals and at a required speed.

This apparatus for forming, filling and sealing accommodates a wide range of pouch widths with few if any change parts. For example, the sealer wheel is adjustable without change parts to effectively vary the operational diameter and circumference of the sealing lands and accommodates the wide range of pouch widths noted. For example, the heat seal lands are mounted on a plate and are, by means of respective clamps, cooperating slots and flanges and the like, radially adjustable, outwardly for wider pouches and inwardly for narrower pouches, fully over the design range of at least about 2.5 to 5.5 inches of pouch width, and without concern over the effective diameter of the lands on the wheel produced by the necessary adjustments. Such radial adjustment could also be accomplished by rack and pinion, gears, or other devices. A "gauge" ring could be provided so that each land is accurately manually adjusted to proper radial position, or the adjustments could be automated electrically, hydraulically, pneumatically or the like. In this way, the vertical sealer module is adjustable without significant change parts to produce transversely sealed pouch trains in a wide range of pouch widths. Moreover, the vertical sealer allows web separation from the sealer lands on cycle stops by way of the movable entry and exit rollers, thus eliminating undesired heat transfer into the pouch web.

As noted above, the operating cams for the gripper jaw units on the filler wheel, or the trailing jaw mount, or both, can be adjusted for accommodating the desired range of pouch widths.

In order to accommodate the top sealing of the pouches after filling and on the filler wheel, the spout wheel thereabove is tilted to a greater degree than in past filler wheel devices handling uncut pouch trains. The entire tilted spout wheel may also be slightly spaced further above the filler wheel from past configurations so the spout discharge ports are disposed in a position to efficiently drop contents into the pouches, yet providing sufficient room under the spout wheel for the top sealer which may be of any suitable design and operation.

Top sealing of the pouches is performed by any suitable form of sealer after the pouches are filled. If sealer jaws or heat lands or platens are used for the top sealing, they are mounted on sliders or other components to be movable away from the pouch tops upon any cycle stop of the operation to prevent undue heat transfer into the pouches or undesirable seal propagation.

In another alternative embodiment, the entire top sealer for the pouch mouths above the gripper jaws is movably mounted so it can be retracted upon machine stoppage to prevent heat propagation which otherwise might burn or destroy the pouches residing in the sealing area.

Moreover, and where required to accommodate and fill pouches efficiently over the entire design range of widths, the spout wheel over the filler wheel is provided with changeable spouts. Thus, a set of spouts can be changed out to another set of spouts to accommodate different pouch widths and without requiring the entire spout wheel to be changed. The spouts can be releasably snapped into place on the same spout wheel, resulting in very quick changeover, where needed. The change spout discharge ends can be angled or positioned differently from another spout set to efficiently fill the pouches, for which the change spouts are designed.

Alternately, the spout plate could be phased to match the spouts with the pouch openings so no replacement spouts are required. Or both change spouts and phasing can be used in combination.

In this regard, the spout wheel and the filler wheel mounting the pouch grippers are effectively driven by separate and independently controlled servo drives. These are controlled so as to properly phase the discharge ends of the spouts with the particular pouch widths or pitch on the filler wheel. By this alternative, a wide variety of pouch widths can be filled with only a servo drive adjustment for alignment purposes.

Also, in this embodiment, a discharge wheel is disposed downstream of the top sealer adjacent the filler wheel to remove filled and sealed pouches from the gripper units. This discharge wheel includes a plurality of vacuum cups for engaging pouches in the gripper units and transporting pouches away from the gripper units and filler wheel when the grippers are cammed or operated to release the pouch and reset for the next empty pouch pickup.

Preferably, two vacuum cups are mounted at each pouch station of the discharge wheel on a pivoted arm. The arm is pivoted beneath the cups to the wheel. These arms are vertically disposed on vacuum cup engagement with the pouches, then pivot outwardly and downwardly so the pouches are received in a vertical disposition then rotated away from the filler to a horizontal position for discharge upon vacuum cup release. Thereafter, the arms are raised for another discharge cycle as the discharge wheel rotates. The speed of the discharge wheel is timed and phased with that of the filler wheel, such as through servos, for the wide range of pouch widths, on the filler wheel.

Alternately, two opposed pinch belts comprise a pouch pinch nip along a pouch pitch line tangentially from the filler wheel downstream of the top sealer. Sealed pouch tops are grasped while leading, then trailing gripper jaws sequentially release their hold on the pouch edges. The belts transport the individual filled and sealed pouches for downstream handling or packaging.

It will be appreciated that components of this invention can be provided in modules so as to provide a high degree of flexibility in system and floor plan design. For example, the web feed and vertical sealer wheel can be provided in one heat sealing module, operably connectable with or separate from a variety of pouch filling and sealing apparatus, including that described in the embodiments above. If the vertical wheel heat sealing module is separate or easily separable from the filling wheel module, for example, wash down of the filling area without contaminating the heat sealing operation is provided.

Moreover, it will be appreciated that the filler wheel as described above can be fed directly from the vertical wheel heat seal apparatus as described, or it could be fed separate pre-cut pouches from a magazine and without the need for a transverse heat seal operation at the time and location of the filling and sealing apparatus, thus providing even more manufacturing flexibility and flexibility in pouch inventory management. This also further demonstrates the lack of need for a coordinated mechanical drive system as in prior units requiring significant change parts on pouch width changes.

In this regard, it is to be appreciated that the vertical sealer wheel on one hand and the filler wheel on the other are preferably independently driven by separate servo drives so they can be coordinated with each other or with other modules or components with which they are used.

Thus, in an alternative embodiment of the invention for pouch handling, it will be appreciated that the vertical sealer wheel disclosed can be used in other pouch handling, filling and sealing applications not limited to the filler and sealer as also described herein.

In another aspect of the invention, the same vertical sealer wheel is used, however, the formed pouch train is not cut before filling. Instead, the pouch train is introduced intact to the filler wheel where the transverse seals are engaged by vacuum lands on the feeder wheel. The pouches are opened traditionally, for example, as shown in U.S. Pat. No. 3,821,873, filled, top sealed, then cut off by a rotary knife.

In this embodiment of the invention, a different combination of elements are used to accommodate a wide range of pouch widths in the range of at least about 2.5 to about 5.5 inches. No gripper units are used in the filler wheel. Instead, change out filler wheels are provided in an annulus, donut or ring form, each of which is preferably within only two to three inches variation in outer diameter of the other. Vacuum lands are mounted about each wheel with a radial spacing from the axis to accommodate the particular pouch size. Vacuum port sets for each filler wheel are provided in distinct radial distances from the center axis of a vacuum shoe. The ports of the wheel cooperate with a designated set of ports in the shoe at a designated radial distance from the center for operation with designated pouch widths. Thus, the vacuum shoe has a plurality of port sets, each in a distinct radial distance from the center and each port set cooperating to convey vacuum to a distinct vacuum land annulus or donut ring carrying the vacuum lands. Thus, to change over for pouches of varied width or pitch, it is only necessary to replace a relatively inexpensive donut or ring with associated vacuum lands, and not the entire filler wheel or vacuum shoe in this embodiment.

Alternately, a changeover could be made with changeable donuts where the same land are quickly changed over from one size donut to another.

A further embodiment could accomplish changeover for different pouch widths by retaining the same donut or ring and replacing the vacuum lands with a different set of lands providing different pouch chord lengths about the filler.

Alternately, the vacuum lands can be radially adjustable in radial slots on the same ring to provide varying land spacing and chord distance between them or handling a range of pouch widths.

Alternately, other forms or structures for providing vacuum to the different vacuum lands can be used.

In this embodiment, the spout change out provisions of the embodiment described above can also be used. Alternately, very lightweight spout plates, each in the form of an annulus and carrying lightweight spouts spaced for the particular pouch width desired can be changed out.

Once filled, the pouch train of this embodiment is top seated and the train of sealed pouches transported to a knife for individual pouch cutoff.

In the past, rotary pouch cutoff knives have been used for this operation and some of these have been adjustable. See, for example, the rotary knives described in U.S. Pat. Nos. 4,872,382; 5,222,422; 5,829,332; 5,575,187; 6,058,818 and 6,553,743, each of which is expressly incorporated by reference as a part hereof. In one form of prior knife, the package guides have been slightly radially adjusted to accommodate varied pouch widths.

In order, however, to accommodate the wide range of filled and sealed pouches now desired, such as about 2.5 to 5.5 inches in width, various knife hubs must be provided in effective diameters beyond that attainable by the adjustment range of these prior knives.

One problem with change out of different diameter major and minor knife hubs is that the distance between their respective axes of rotation must be changed since the effective knife hub diameters are significantly changed. This requires accurate drive gears on the ends of each hub shaft to avoid drive lash and change-out parts which are expensive.

This invention contemplates an improved knife where the wide range of pouch widths is accommodated by major and minor knife hub change parts and the combination therewith of a four-gear anti-lash drive train, pivotally mounted to accommodate changes in the distance between the respective rotational axes of the hubs.

Each knife set up for a selected pouch width includes a set of major and minor knife hubs with respective effective diameters for the width selected. Other sets have different effective cooperating hub diameters with different spacing required for their parallel drive axes. Accordingly, an upper, minor knife hub is mounted on a minor hub shaft, the axis of which is journaled in a movable bell housing. When released, the bell housing can be moved to change the distance between the minor hub axis and the fixed major hub axis, accommodating different diameter knife hubs.

A drive gear is mounted on the major knife hub, and a slave gear on the shaft of the minor hub. Two meshed anti-lash gears are mounted on a pivoted gear arm with one of these gears engaging the drive gear and the other the minor hub shaft slave gear.

When the knife hubs are changed, the gear arm is adjusted to accommodate the different center-to-center distance between the fixed axis of the major knife hub and the repositioned axis of the minor knife hub. Specifically, the axis on the first anti-lash gear is coaxial with the gear arm pivot. The axis of the second anti-lash gear is fixed on the arm with respect to the axis of the first anti-last gear, but is movable away from gear engagement as the arm is pivoted with respect to the slave gear on the minor hub axis to accommodate its movement with respect to the drive gear and major hub axis. Once the minor hub is set, the gear arm is pivoted to re-engage the slave gear on its axis and the anti-lash drive thus reestablished, even though the spacing between the major and minor hub axes has changed.

In addition, the major knife hub is provided with radially adjustable package guides to handle a range of pouch widths. However, the mechanisms by which the package guides of the major knife hub are radially adjusted is different from that of prior mechanisms. The prior adjustment cones shown in the prior patents are eliminated. Instead, the respective package guides are mounted on threaded, extensible carrier rods having beveled gears on their radially inner ends. Each of these engages a common beveled drive gear which is phase adjustable through the major knife hub structure to change the radial extent and thus the circumferential spacing of the package guides for fine tuning of the pouch widths or chords desired.

This knife apparatus eliminates the weight and complexity of the prior screw and cone adjustable knife hubs, rendering the cutting operations for varied pouch widths over the design range less expensive and at the same time adjustable over a wider pitch range. Thus, while it is contemplated that while knife hub change out may be required to meet the extremes of the design pouch range from about 2.5 to 5.5 inches in width, the hubs are lighter than prior devices. At the same time, the use of the four-gear drive provides accurate registration, hub cooperation which accommodating varied shaft spacing.

Accordingly, while this alternate pouch forming, filling and sealing embodiment involves more change-out parts than the prior embodiment described, it yet requires fewer and less complex change-out parts than prior systems for the desired pouch width variation ranges.

These and other objectives and advantages of the invention will be readily appreciated from the foregoing, and from the following description and drawings, in which:

BRIEF DESCRIPTION OF THE DRAWINGS

The accompanying drawings, which are incorporated in and constitute a part of this specification, illustrate embodiments of the invention and, together with a general description of the invention given above and the detailed description given below, serve to explain the invention.

FIG. 19 is a perspective illustration of an alternate top sealer of the invention, movable vertically and horizontally between sealing and retracted positions to prevent undesired heat propagation into the pouch film upon emergency or cycle stops or the like.

DETAILED DESCRIPTION

Turning now to the drawings, it will be appreciated that FIGS. 1-9B illustrate various features of one embodiment of the invention, for example, where the pouches are formed on the vertical sealer wheel then separated before they are introduced to a filler wheel. The separated pouches are thereafter filled, sealed and discharged.

Figure 11:
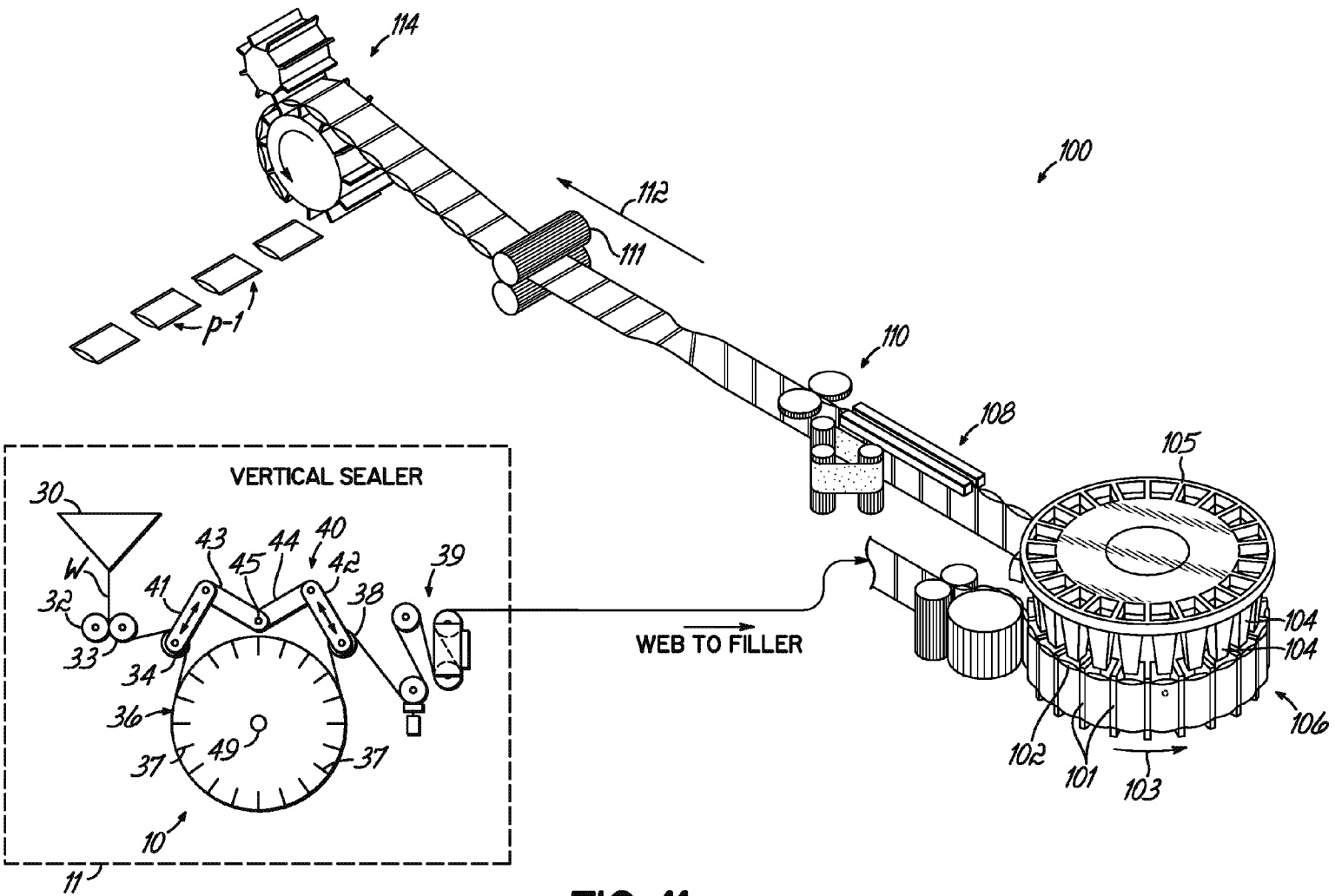
FIG. 11 is an illustrative perspective view of an alternate embodiment of the invention with pouches in a pouch train being filled and sealed before cutting.
Figure 12:
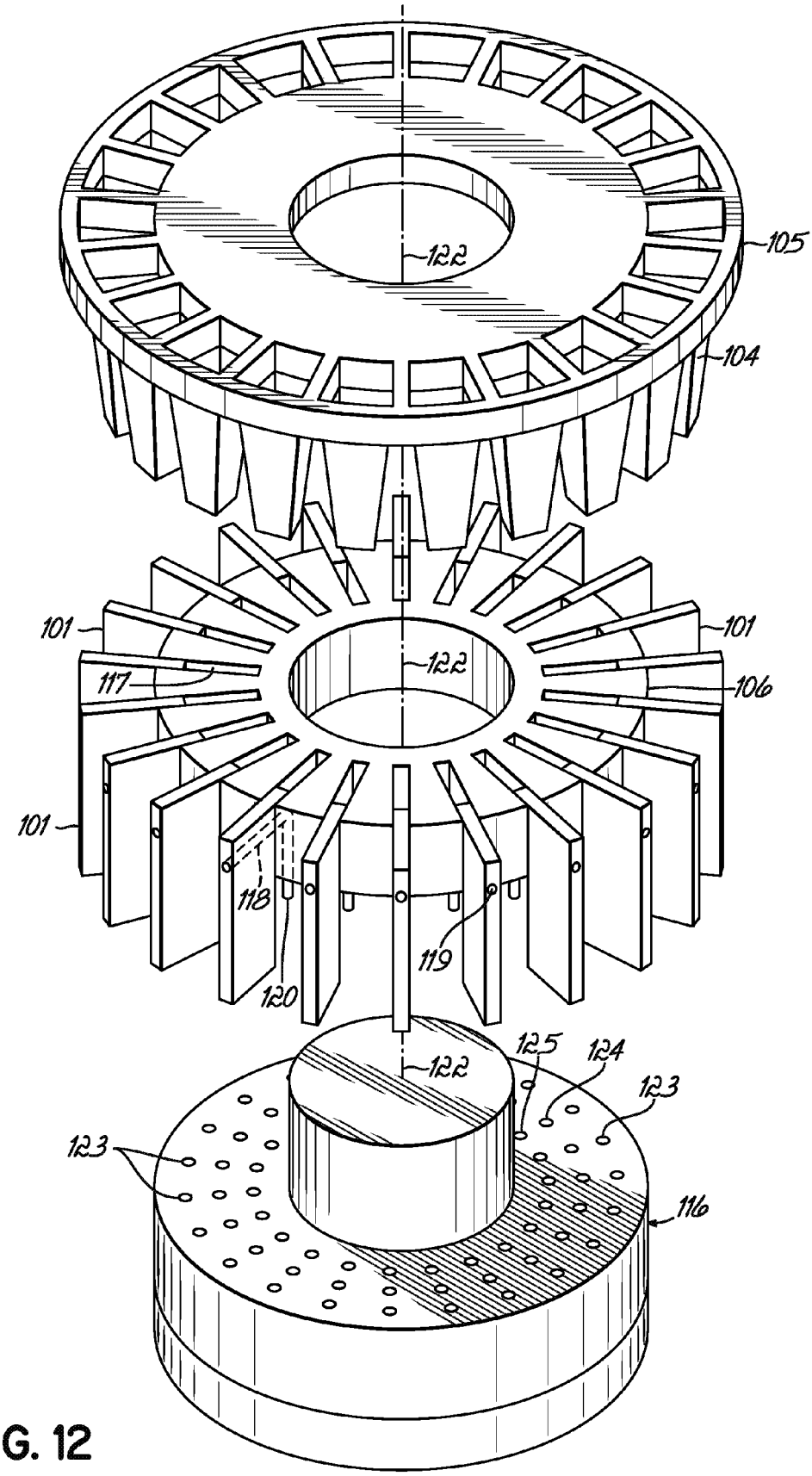
FIG. 12 is an illustrative exploded view of changeable filler and spout wheels of one alternate embodiment of the invention as in FIG. 11.

In another embodiment of the invention, such as shown in FIGS. 11 and 12, the pouches are formed on the vertical sealer wheel, but are introduced to the filler wheel in a pouch train, where the pouches are filled, the tops are sealed, and thereafter the pouches are cut off, one from the other, for discharge.

Other embodiments of the invention or components of the two embodiments described above are shown in the additional Figures.

Figure 1:
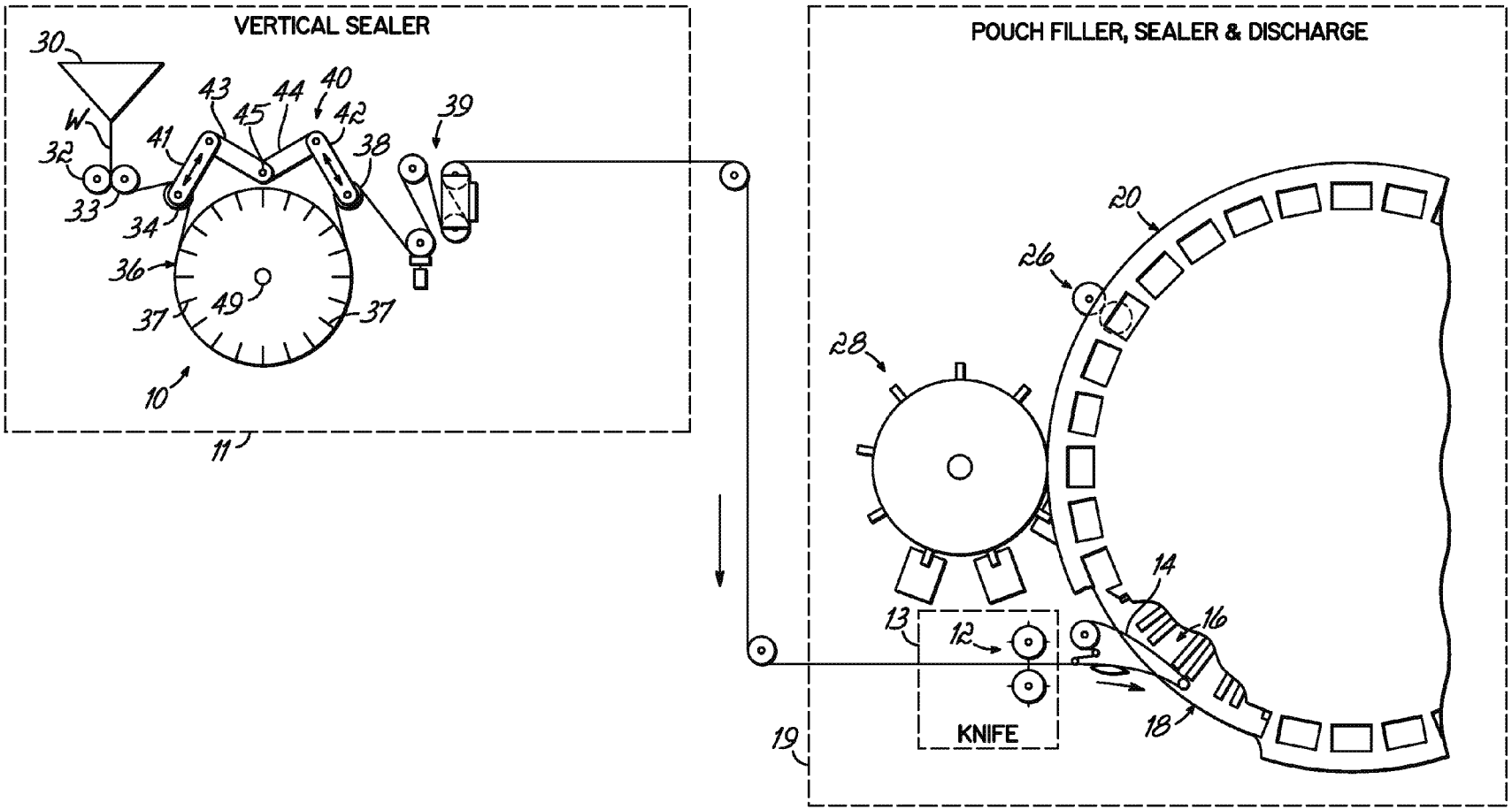
FIG. 1 is an illustrative view of one embodiment of pouch forming, filling and sealing according to the invention, with a vertical sealer wheel module and a filler/sealer wheel module.

Turning now to FIGS. 1-9B, a first embodiment of the invention will be described. FIG. 1 illustrates the overall layout of the first embodiment of the invention. In FIG. 1, there is shown a vertical sealer 10, preferably constructed as a first sealer module 11 with a vertically oriented sealer wheel rotatable about a generally horizontal axis. From the vertical sealer 10, the web W is transported to a knife apparatus 12, illustrated in a knife module 13. This is also clearly illustrated in FIG. 5, and it will be appreciated that the module 12 also includes a vacuum belt transport 14 for conveying cut pouches from the knife 12 to the filler wheel as will be described.

With further reference to FIG. 1, the individual pouches are introduced to respective gripper units 16, mounted on the filler wheel 18 of a filler module 19. One such gripper unit 62 is shown, for example, in FIGS. 9, 9A and 9B as will be described, while other alternative grippers are shown in FIGS. 10, 17, 19 and 20.

Filler wheel 18 is generally circular and resides under a spout wheel 20 (as shown in the various figures), carrying a plurality of spouts 22. As perhaps best seen in FIG. 7 the spout wheel 20 is tilted at an angle with respect to the filler wheel 18. Such angle may be, for example, approximately three degrees. As viewed in the right hand side of FIG. 7, the spouts are positioned downwardly and over the pouches, so that the transfer of product can be efficiently made from the bottom discharge opening of the spouts into the pouches as will be described.

Figure 5:
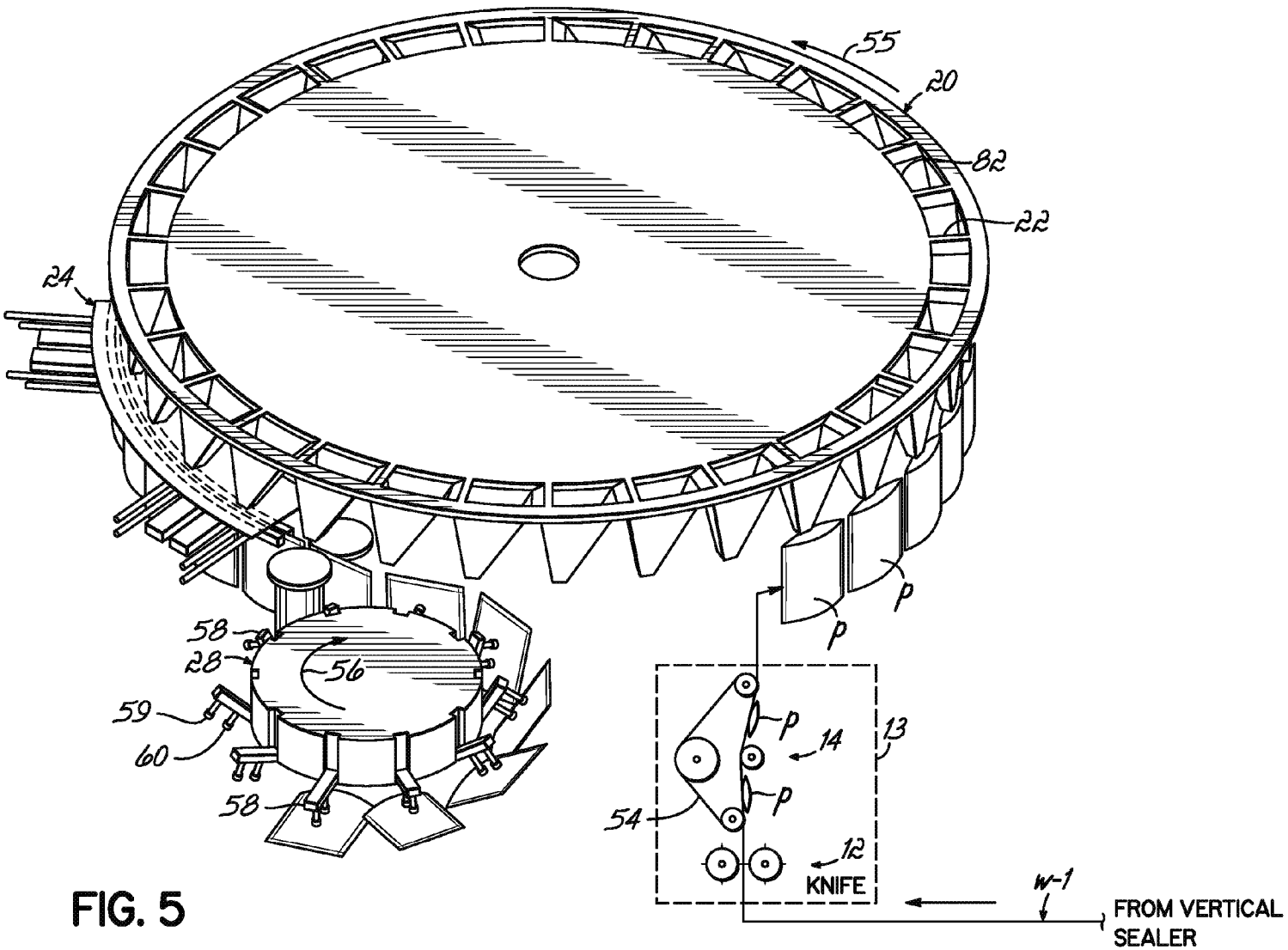
FIG. 5 is an illustrative perspective view of the knife, filler wheel, sealer and discharge wheel according to one embodiment of the invention but with the filler wheel and gripper units removed for clarity.
Figure 6:
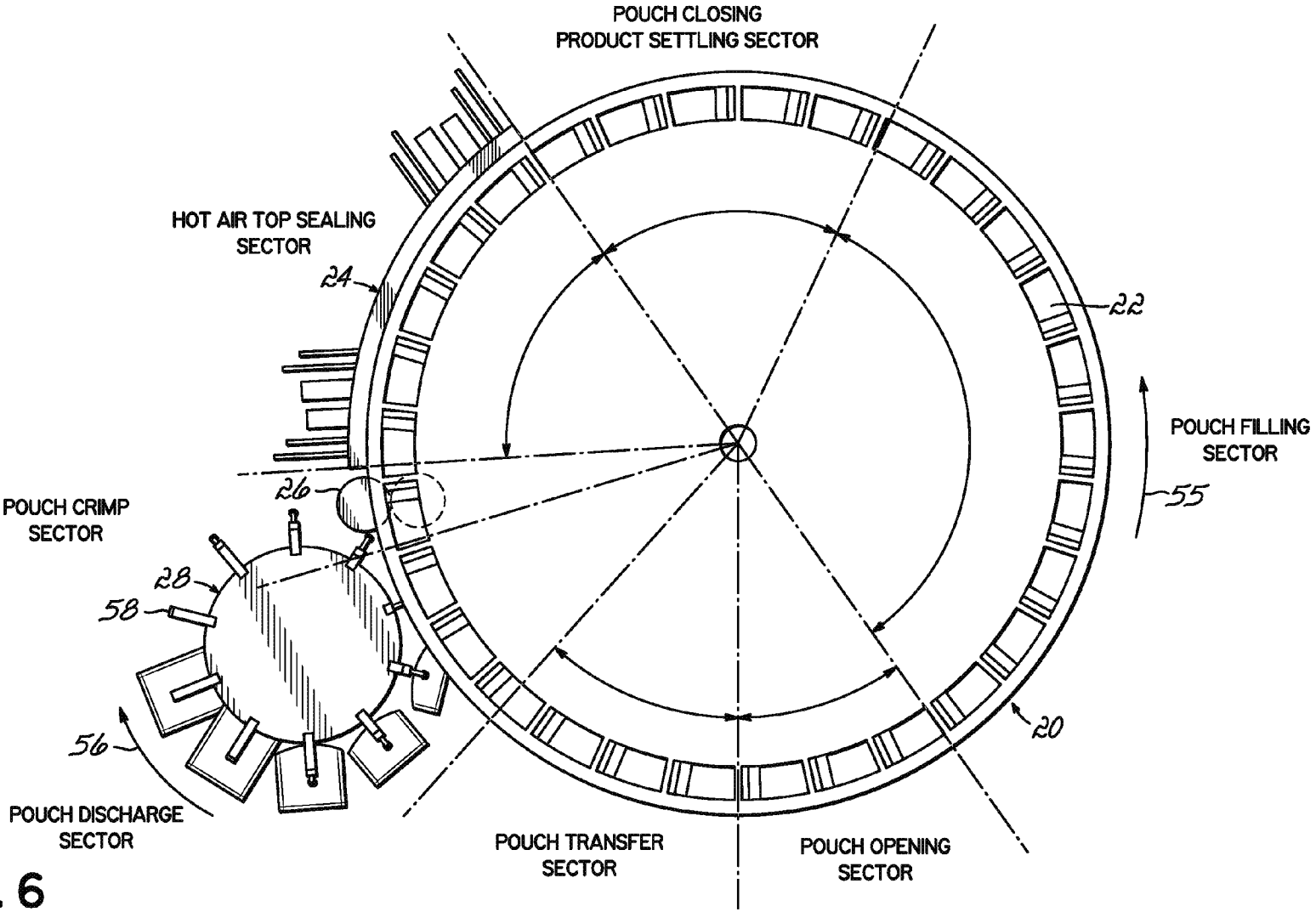
FIG. 6 is an illustrative top view of the spout wheel over the filler wheel and discharge wheel according to one embodiment of the invention.

Once the pouches are carried about the filler wheel through a filling sector as will be described, the tops of the filled but still open pouches are tensioned by moving the pouch edges apart so that the tops close. Tops of the pouches are then sealed, such as by a sealer apparatus 24, as shown in FIGS. 5 and 6, for example.

Once the pouch tops are sealed at sealer 24, they may be run through a final crimp roller, such as at 26 in FIG. 1 and from there, are transferred to a discharge wheel 28, as will be described. The discharge wheel of this embodiment removes the vertically oriented pouches from the filler wheel 18 and rotates the pouches to a horizontal position for discharge and further transfer to pouch packaging or further treatment equipment.

Turning now to FIGS. 1-4, the vertical sealer 10 will now be described. It will be appreciated this vertical sealer preferably comprises a pouch forming module which can be used or coupled with the filler module 19 or in other web or pouch handling operations as appropriate.

Figure 2:
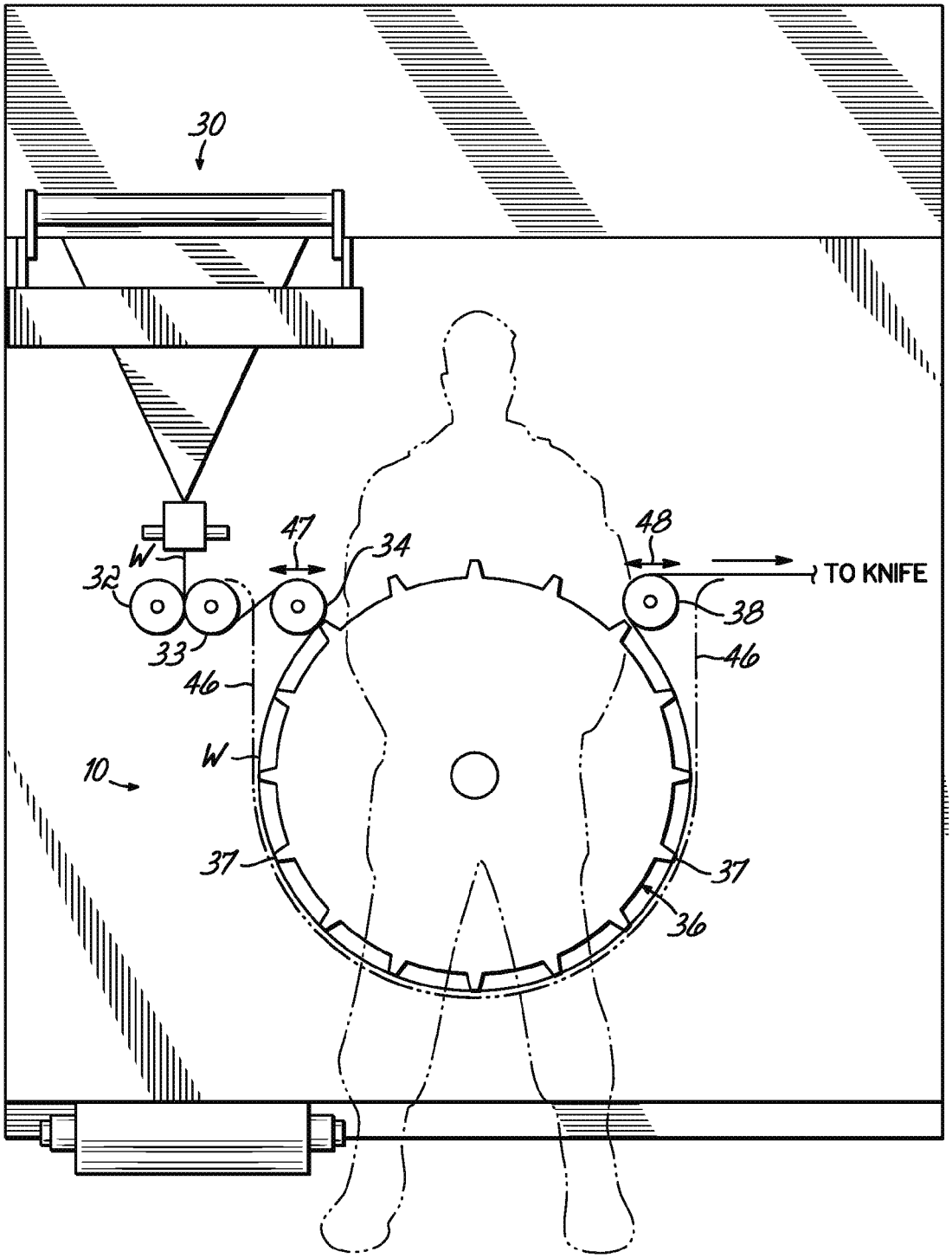
FIG. 2 is an illustrative elevational view of a horizontal shaft, vertically oriented, transverse sealer wheel according to the invention and also showing the pouch web in relaxed position around the wheel in phantom.

FIGS. 1 and 2 perhaps best show the general features of the vertical sealer 10. As illustrated in the figures, a web supply, such as 30, of any suitable design, feeds a folded web W to the vertical sealer 10. Preferably, a web is folded longitudinally to provide a folded, multiple ply web with the fold comprising the bottom of the to-be-formed pouches. Alternately, two plies, sealed along one edge to form the pouch bottom could be used. In particular, in a preferred embodiment, the folded web W is fed through appropriate web control rollers 32, 33 to an entry roller 34. From there, the folded web W is entrained about a vertically oriented sealer wheel 36, provided with a plurality of horizontally oriented heated sealing lands 37. Sealer wheel 36 is mounted on a generally horizontal axis for rotation in a generally vertical plane. From the vertical sealer wheel 36, the web is entrained about a web exit roller 38, through a web roller control apparatus 39, of any suitable construction, including dancer rollers or the like, as shown in FIG. 1, and from there the web is introduced as shown in FIG. 1 to the knife module 13. When the web exits the wheel 36, a plurality of seals has been placed in the web to define a train of open-top pouches.

As shown in FIG. 1, the web entry roller 34 and exit roller 38 of one embodiment are mounted on a pivoted arm mechanism 40. Specifically, retractable or movable rollers 34, 38 are mounted on the respective pivot arms 41, 42, which are in turn secured to respective pivot arms 43, 44, which have distal ends pivoted to a fixed pivot 45.

Any suitable drive mechanism is used to pivot the arms about the fixed pivot 45. This pivots the respective interconnecting arms 43, 41 and 44, 42 so as to extend the web entry roller 34 and the web exit roller 38 outwardly and away from the sealer wheel 36.

Accordingly, it will be appreciated that when the rollers 34, 38 are in the solid-line, web-tensioning positions shown in FIGS. 1 and 2, the web W is tensioned about the sealer wheel 36, so that the web is urged against and engages the heated sealing lands 37. This engagement of the multiple ply web with the heated lands forms transverse seals across the web from the folded bottom to the upper edges of the plies defining open pouch tops, thus forming a web having a plurality of transverse seals spaced apart and defining open top, individual pouches, but nevertheless, each pouch still being a part of an unbroken web.

On the other hand, upon cycle stops, for example, when wheel 36 is stationary, the rollers 34, 38 are moved apart and away from the vertical sealer wheel 36 to respective web relax positions such that the tension in the web is relaxed and it takes on the relaxed configuration as shown in the phantom lines 46 of FIG. 2 where it will preferably disengage from the lands 37. These lines are approximations, illustrating that the web tension is relaxed and the web falls away from the heated lands of wheel 36. In this configuration then, the tension of the web against the lands 38 is relaxed and this relaxation spaces the folded web from lands 38, thus inhibiting transfer of heat from the horizontal sealing lands to the multiple plies of the web. This prevents transfer of undue heat to the web and prevents undesired seal propagation in the web.

Thus, where the web entry and exit rollers 34, 38 are moved away from the sealer wheel 36, the web may sag downwardly and away from the wheel, such that it is no longer in contact with the lands or, while the web might still contact the lands, it is not held against the lands with such tension that undue heat is transferred. The motion of the rollers 34, 38 are indicated by the arrows 47, 48 respectively, in FIG. 2.

Figure 1A:
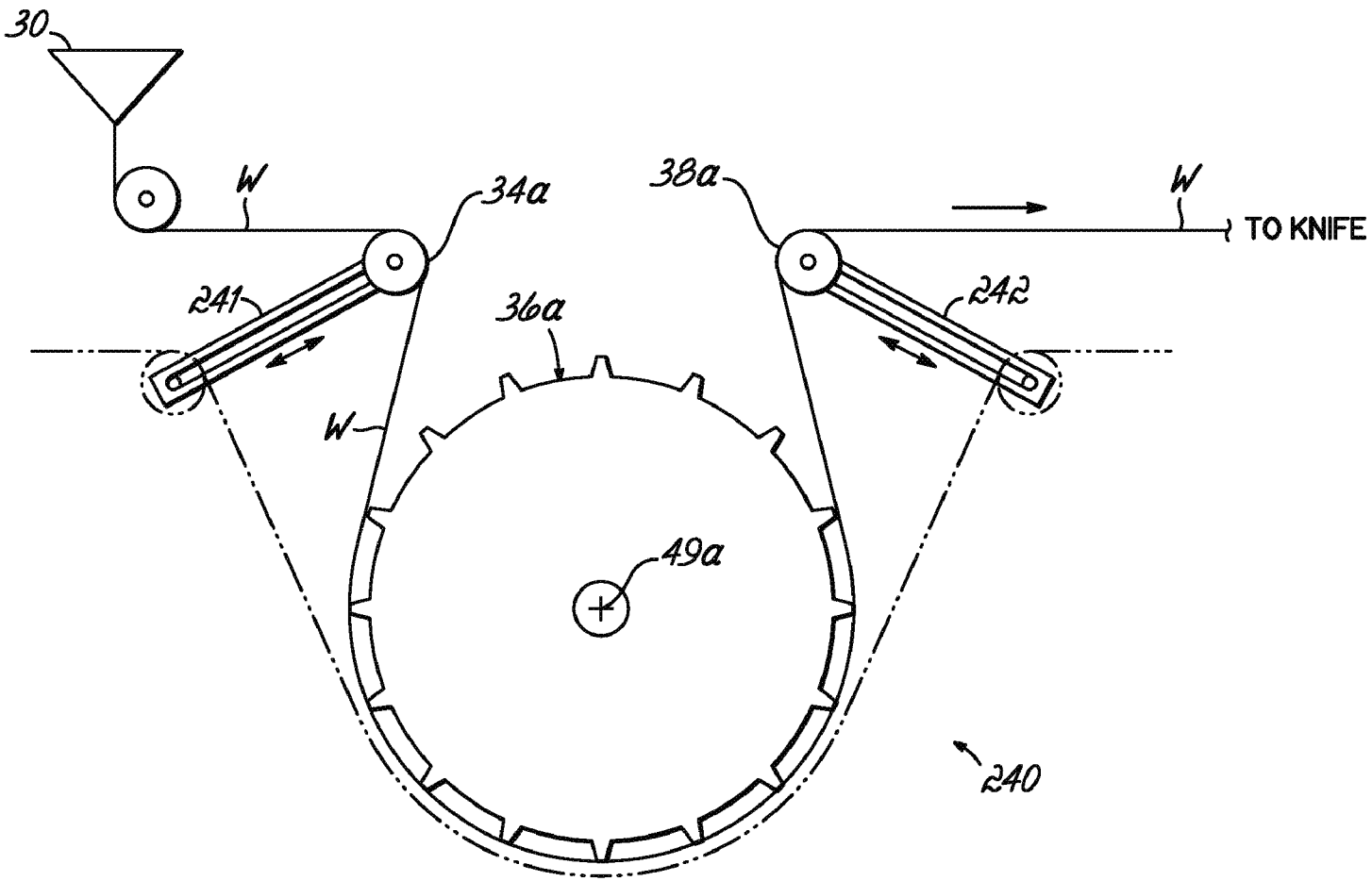
FIG. 1A illustrates in elevational view of an alternate vertical sealer to that of FIG. 1.

In an alternate and preferred configuration, shown in FIG. 1A, a vertical sealer 240 includes tension rollers 34*a*, 38*a* mounted on elongated tracks 241, 242 oblique to the filler wheel 36 or on the axis 49*a*. Movement of rollers from one to another position along the track results in a similar web relaxation, allowing the web to sag from the wheel 36 and its heated lands, preventing undue heat propagation in the web upon emergency, cycle or other stops. Rollers 34*a*, 38*a* are moved between web tensioning positions shown in solid lines and web relaxed positions shown in phantom. When rollers 34*a*, 38*a* move closer together, multiple ply web W is tensioned against sealer wheel 36*a*. When those rollers are moved away from one another, the web tension is relaxed and the web preferably moves away (phantom lines) from wheel 36*a*.

With respect to both vertical sealer embodiments, it will be appreciated the distance between rollers 34, 38 and 34*a*, 38*a* is less than the diameter of the sealer wheel 36 or 36*a*, at least in the web tensioning position.

It will be appreciated that the rollers are moved obliquely by any suitable expedient, including but not limited to, the embodiments shown and other hydraulic or pneumatic cylinders, solenoids, linear motors or the like.

It will also be appreciated that the web supply 30 diagrammatically illustrated in FIGS. 1 and 2 could be defined as part of the sealer operation module or could itself be defined in a separate module, for example, located at a position adjacent or just behind the sealer module 11.

Figure 3:
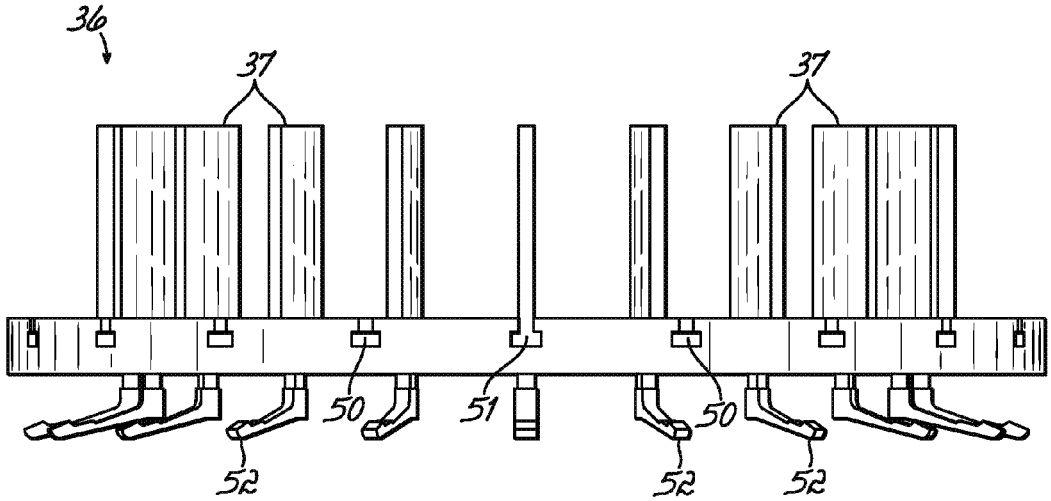
FIG. 3 is an illustrative side view of a vertical sealer wheel of FIG. 1 (shown for clarity on its side)
Figure 4:
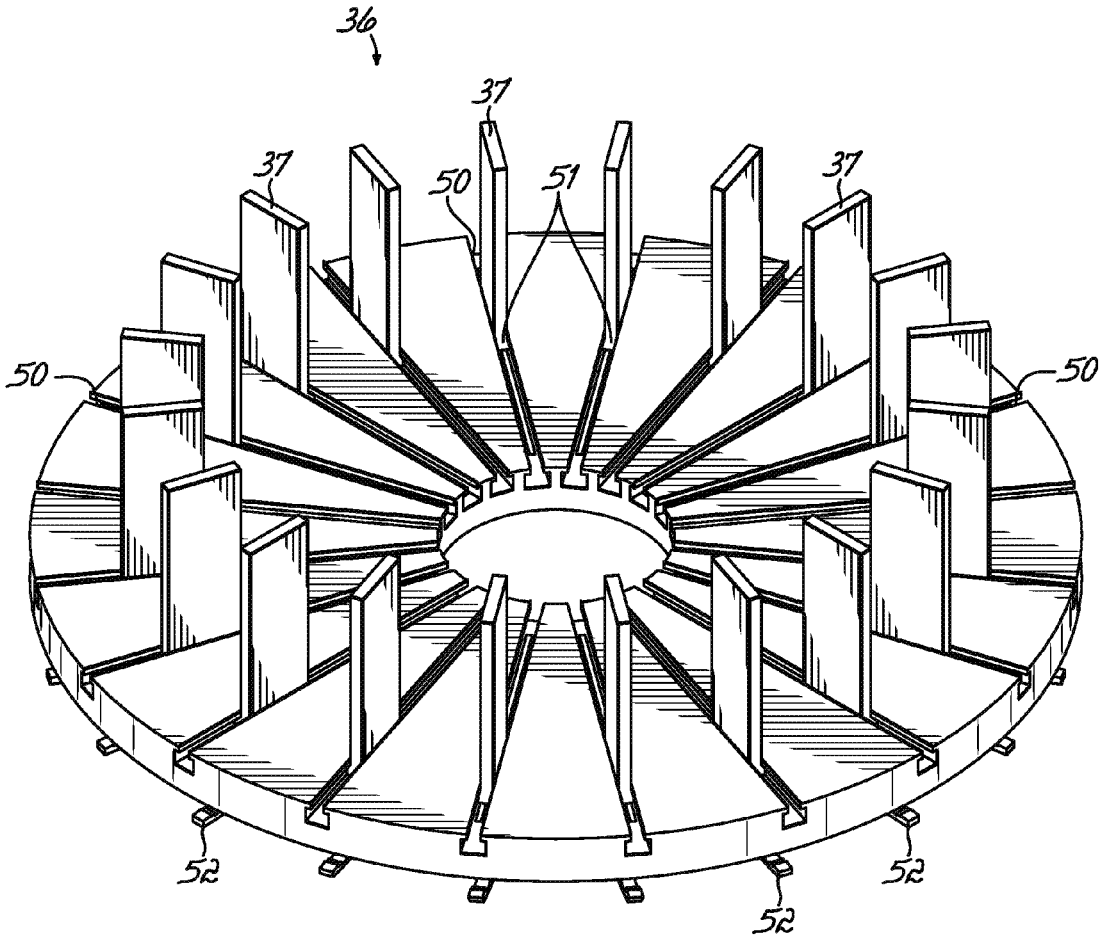
FIG. 4 is an illustrative perspective view of the respective sealing lands of the vertical sealer wheel of FIGS. 1-3.

Turning now to FIGS. 3 and 4, there is illustrated in these figures various views of a vertical sealer wheel according to the invention. It will be appreciated that the vertical sealer wheel in operation is vertically oriented about a horizontal axis illustrated at 49 in FIG. 1 so that that axis is also parallel to the horizontally-oriented elongated heat sealing lands 37.

Taking a closer look at sealer wheel 36 in FIGS. 3-4, it will be appreciated that the sealer wheel 36 is generally circular and is provided with a plurality of slots 50 in one wheel surface extending radially outward from the center of the wheel. Each of these slots, for example, may comprise in cross-section, a T-shaped configuration as illustrated in FIG. 3. A plurality of heatable sealing lands 37 are disposed within the slots 50. Each of the sealing lands has a top rib, such as at 51, fitting within the T-shaped slots 50 so that the land can be moved in a radial direction with respect to the wheel and the slots.

Each of the lands is also provided with a clamping apparatus such as a handle 52 adapted to screw into the upper portion of the land, where it engages the wheel, and adapted to be tightened to secure the respective land in position slot 50. Thus, each land can be moved radially inwardly and outwardly on the wheel and set by means of the clamping handle 52. The particular structural features of the upper portion of the lands 37 and the clamping handles 52 can be provided in any suitable design.

It will be appreciated then, that the lands can be adjusted by this means and that the effective diameter and circumference of the lands and vertical sealer is thus set by, and dependent on, the radial position of the lands 37 on the sealer wheel 36.

Accordingly, for pouches of wider dimension at the extreme end of the range, for example, the lands can be moved radially outwardly. To handle smaller pouches, the lands are moved radially inwardly, so that the chord length, that is the distance between each of the lands, is changeable over the range or selected range of pouch widths to be handled on the vertical sealer while the wheel 36 itself remains the same circumference and diameter. Without change parts, the vertical sealer thus accommodates a wide range of pouch widths.

In this regard, it will be appreciated that the web entry and exit rollers 34, 38 can be adjusted so as to properly tension the web around the sealer wheel for all selected pouch dimensions (and land circumferences) within the design range.

Finally, it will be appreciated that each of the lands is provided with a heater apparatus as is well known in the art and of any suitable configuration and variety, in order to present heated land surfaces to the film to be engaged thereon, so as to impart the appropriate amount of heat to the web film and create a seal between the folded web sides.

Turning now to FIG. 5, the transversely sealed web W-1 is transported to knife module 13. There, the individual pouches P are cut off, separated from the web W-1 and are transferred by any suitable vacuum belt 54 to gripper units 16 mounted on the filler wheel 18. Each gripper unit may be constructed in any suitable form, such as, for example, the gripper unit shown in U.S. Pat. No. 4,956,964. Alternately, the gripper units may take the form, for example, illustrated in FIGS. 9 to 10 or 17, 19 or 20 described below.

In any event, it will be appreciated that each gripper unit, including the jaws thereof, is preferably mounted on or directly to the filler wheel. They are not mounted on or carried by chains as was the prior custom. The gripper units define pouch stations about the filler wheel. Each gripper unit is operable to receive the unfilled pouch feeding from the knife 12 to facilitate opening of the pouch, to hold the pouch while it is being filled, to facilitate closing and top sealing of the pouch and thereafter being reset to receive further pouches from the knife as the filler wheel 18 rotates.

Figure 7:
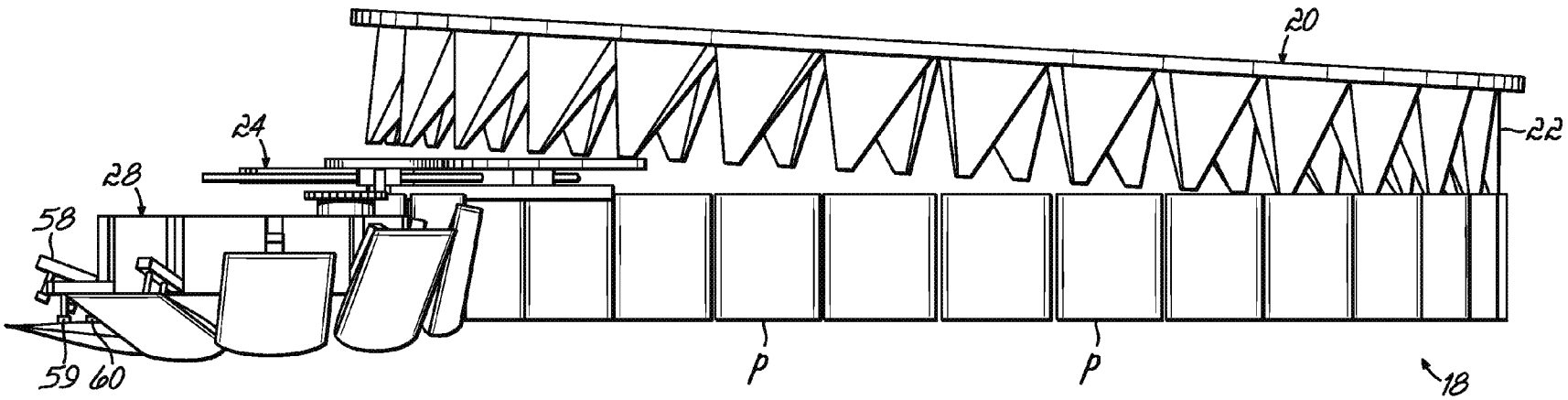
FIG. 7 is an illustrative elevational view of the spout wheel, filler wheel and discharge wheel of one embodiment of the invention of FIGS. 1-6 but omitting detail of the pouch gripper units and the knife for clarity.
Figure 8:
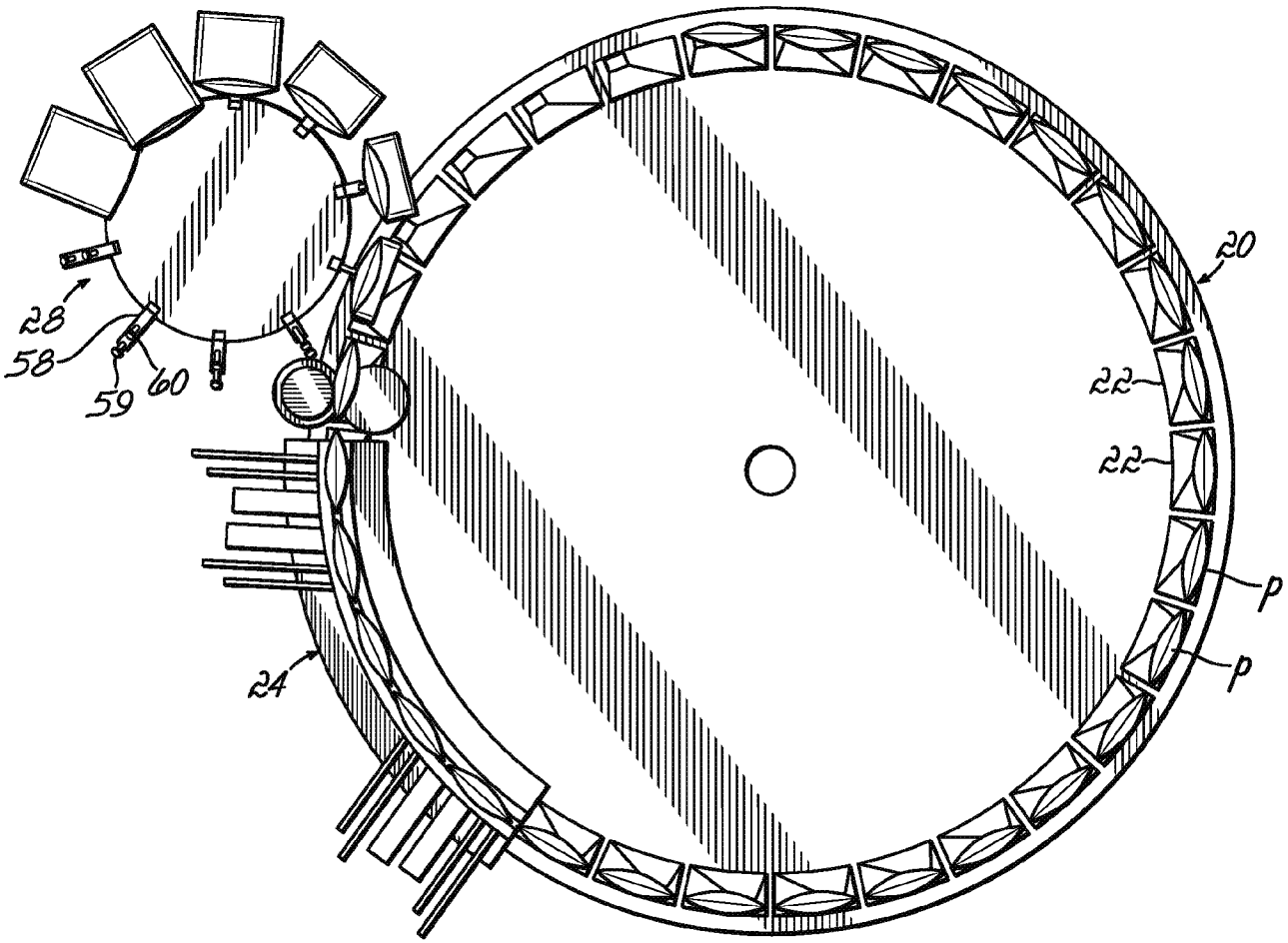
FIG. 8 is an illustrative bottom view of the spout wheel, top sealer and discharge wheel of one embodiment of the invention of FIGS. 1-7, with the knife and filler wheel removed for clarity in this view.

This entire cutting, filling, sealing and discharge operation is illustrated, for example, in FIG. 5, with various features thereof also illustrated in FIGS. 6-8. From FIGS. 5 and 6, it will be appreciated that the pouches P are introduced to the filler wheel 18 at one point on the wheel, and thereafter the pouches are conveyed through filling, closing, product settling and sealing sectors to the discharge wheel 28 and the discharge sector, where the pouches are removed from the gripper units 16 on the filler wheel 18 and are reoriented from a vertical to a horizontal disposition for later discharge.

In this regard, it will be appreciated that the filler wheel rotates in the direction of the arrow 55 (FIGS. 5-6) while the discharge wheel 28 rotates in the direction of arrow 56 (FIGS. 5-6) for transferring the pouches from wheel 18 to discharge.

With particular respect to the discharge wheel 28, it will be appreciated that the wheel has a plurality of pivot arms 58. Each pivot arm 58 is pivoted at its bottom to the discharge wheel 28 and each preferably carries with it two suction cups 59, 60 for attaching to the closed pouches.

In operation, the suction cups 59, 60 attach to the outside surface of a pouch while it is retained in the gripper units 16 on the filler wheel 18. Once vacuum is established by the cups 59, 60 on the outside surface of the pouch, the gripper units are operated as will be described, releasing the pouches as the discharge wheel continues its rotation in the direction of arrow 56. At the same time, the pivot arms 58 are pivoted at the bottom to move the pouches from the vertical orientation on the filler wheel 18 to the horizontal orientation as illustrated in FIGS. 5-8, thereby removing the filled and seal pouches for discharge from the operation. Vacuum ceases or pressure then applied to eject the now horizontal pouches. Thereafter the pivot arms 58 are rotated to their vertical position, where they can serve to introduce the vacuum cups 59, 60 thereon to further pouches being discharged from the filler wheel 18. Pivot arms 58 can be cam operated and any appropriate vacuum/pressure control used to energize the cup suction or discharge. Thus, the discharge wheel facilitates the orienting of discharging pouches to a horizontal position.

It will be appreciated that FIGS. 5-8 also illustrate the spout wheel which is located above the filler wheel 18. The spout wheel 20 carries a plurality of spouts 22 for motion in a circular path in a plane which is oriented at an angle with respect to the circular path in a plan defined by the rotation of the filler wheel 18. The spout wheel 20 supports a spouts 22 and is phased with the filler wheel to present lower or bottom discharge ports of the spouts 22 in the proper position for filling into respective pouches carried by the filler wheel 18.

As the spout wheel 20 rotates above the filler wheel 18, it will be appreciated that the spouts 22 on the right hand side of the apparatus as shown in FIG. 7, move toward the pouches P in the pouch filling sector (FIG. 6) but then the spouts are inclined upwardly and away from the filler wheel 18 as they move toward the closing sector (FIG. 6). This is in order to clear the sealer apparatus 24 which can be mounted on reciprocable rods as indicated in FIG. 7 for selectively engaging and then withdrawing from the tops of the pouches to seal them. It will be appreciated that the hot air sealing apparatus 24 is substantially disposed beneath the spout wheel 22 and above the filler wheel 18, or at least the outer circumference thereof.

Figure 9:
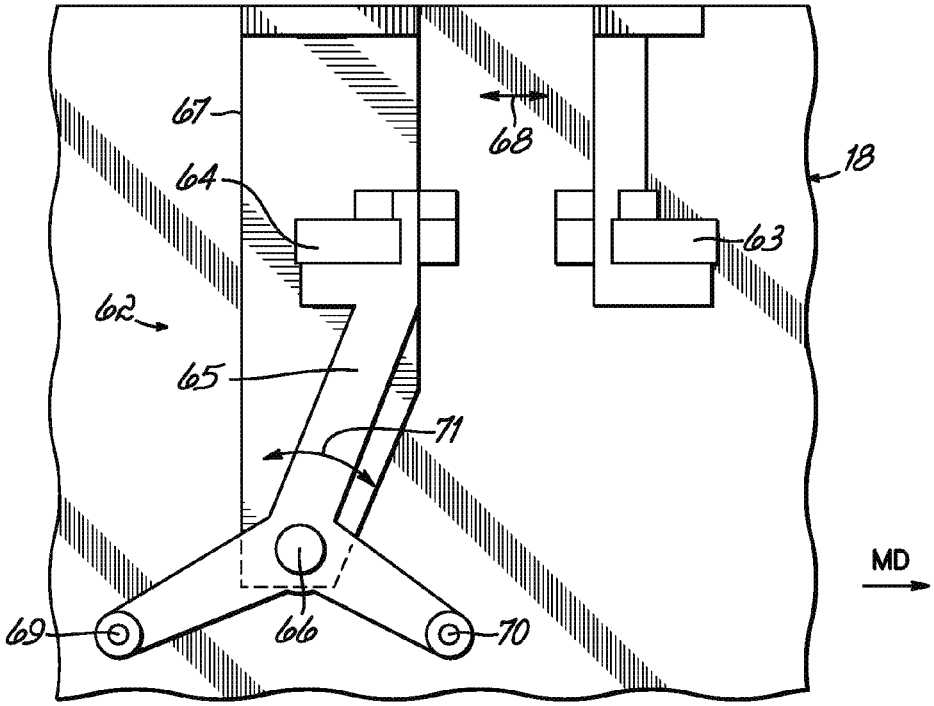
FIG. 9 is an illustrative elevational view of one embodiment of a gripper unit having a leading jaw and a trailing jaw pivotally mounted on an adjustable mounting plate according to the invention.
Figure 10:
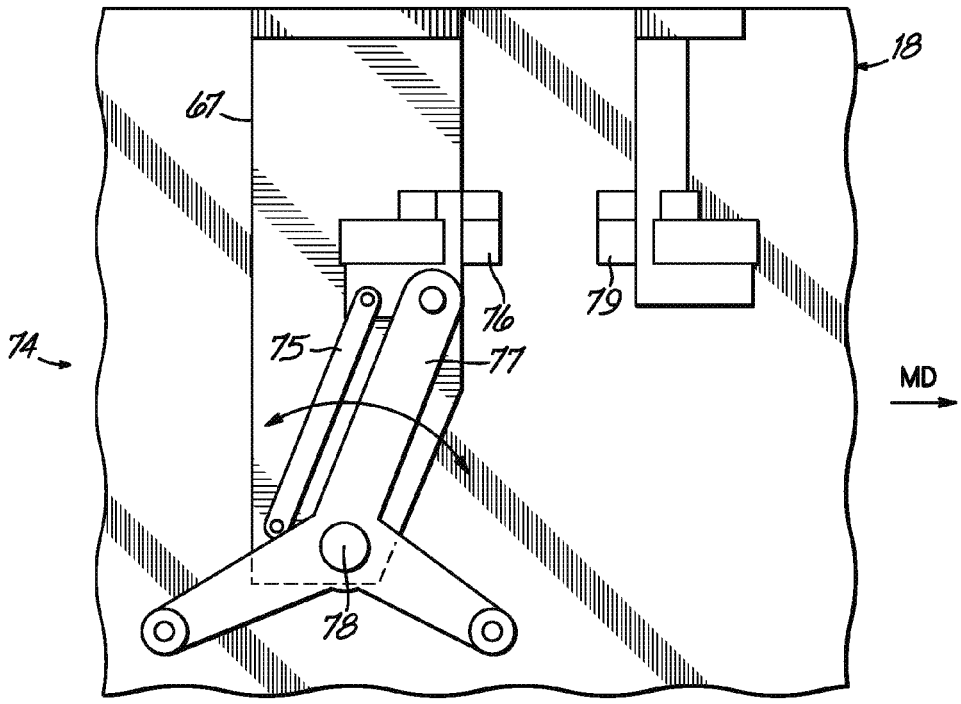
FIG. 10 is an elevational view of an alternate gripper unit with a parallel link mount.

Brief reference is made to FIGS. 9-10 showing two different embodiments of a gripper unit 16. As previously stated, the gripper unit 16 can be any suitable form of gripper unit such as, for example, that shown in U.S. Pat. No. 4,956,964. Alternately, the gripper unit can be any form of gripper unit such as shown in FIGS. 9-10. In any event, the gripper units are mounted on or to the filler wheel 18.

With respect to FIG. 9, for example, a gripper unit 62 is illustrated and includes a fixed, leading jaw 63 and a pivoted trailing jaw 64. As used herein, the term "jaw" is sometimes used to mean both the clamping structure and/or the carrying arms on which the clamping structure is carried. Leading jaw 63 is preferably fixed to or directly mounted on the filler wheel 18 or to intermediate components fixed to the filler wheel. Trailing jaw 64, however, is mounted on a jaw actuator arm 65 pivoted at 66, to a bracket 67. Bracket 67 is adjustably secured to the filler wheel 18 by any suitable means, such as bolts and slots provided within the respective wheel 18 and bracket 67. The bracket 67 can thus be adjusted in the direction of arrow 68, so that the jaw 64 can be adjusted toward or away from the leading jaw 63 to accommodate a wide range of pouch widths, without requiring change parts.

The gripper jaw actuator arm 65 is provided with cam followers 69, 70, which are respectively engaged by cams situated about the filler wheel 18 for moving the jaw 64 in appropriate directions (arrow 68) toward and away from the leading jaw 63 as the gripper unit 62 is transported about the circumference defined by the filler wheel 18 in the direction of arrow MD. As previously stated, various cams are provided for engaging cam followers 69, 70 to move the actuator in the direction of arrow 71 about pivot point 66. Any suitable adjustable cam structure can be used.

In operation, the bracket 67 is adjusted, for example, toward or away from the leading jaw 63, so that the trailing jaw is brought into position for handling the particular pouch width being handled. It will be appreciated that both the jaws 63, 64 extend outwardly from the paper in the view of FIG. 9 to grasp a sealed edge of the cut pouch presented to the gripper unit 67 (see FIG. 9A).

As the gripper unit is transported about the circumferential path defined by the filler wheel 18, a pouch from knife 12 is first gripped by the jaw 63. Thereafter, the trailing jaw 64 is pivoted by actuator arm 65 to catch up to the opposite trailing side of the pouch and to grip it along the seam. This motion also moves the trailing pouch edge toward the leading edge seam to slightly open the pouch mouth by moving the edge seals closer together, so that the top edges of pouch web sides are slightly buckled or opened.

Thereafter, the pouches can be further opened by any suitable mechanism, such as an air flow, and filled as they traverse through the filling sector (FIG. 6) defined by the filler wheel 18. After filling, the jaw actuator 65 is rotated by appropriately adjusted cams to pivot the trailing jaw 64 in the opposite direction away from leading jaw 63 about pivot 66 to stretch the mouth of the pouch tight for sealing.

In a slight alternate embodiment to this, it may be possible to size the actuator 65 and the location of the pivot point 66, such that the adjustable bracket 67 could be eliminated, and thus use adjustable motion of the actuator 65 and the jaw 64 to accommodate the full range of pouch widths to be handled. In such a configuration, of course, it will be appreciated that the jaw 64 will engage the trailing edge of the pouch at a higher level than the same jaw 64 would engage the trailing edge of a smaller width pouch. Of course, a variety of cam structures can be used to actuate the jaw actuator 65 for either of these embodiments.

Figure 9A:
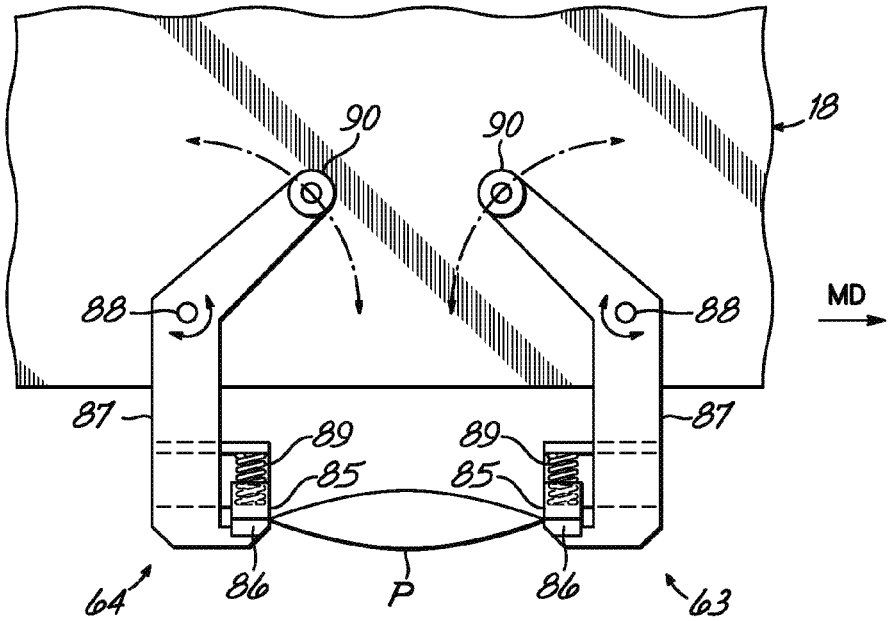
FIG. 9A is a top view of leading and trailing pouch gripper jaws according to the invention of FIGS. 1-9.
Figure 9B:
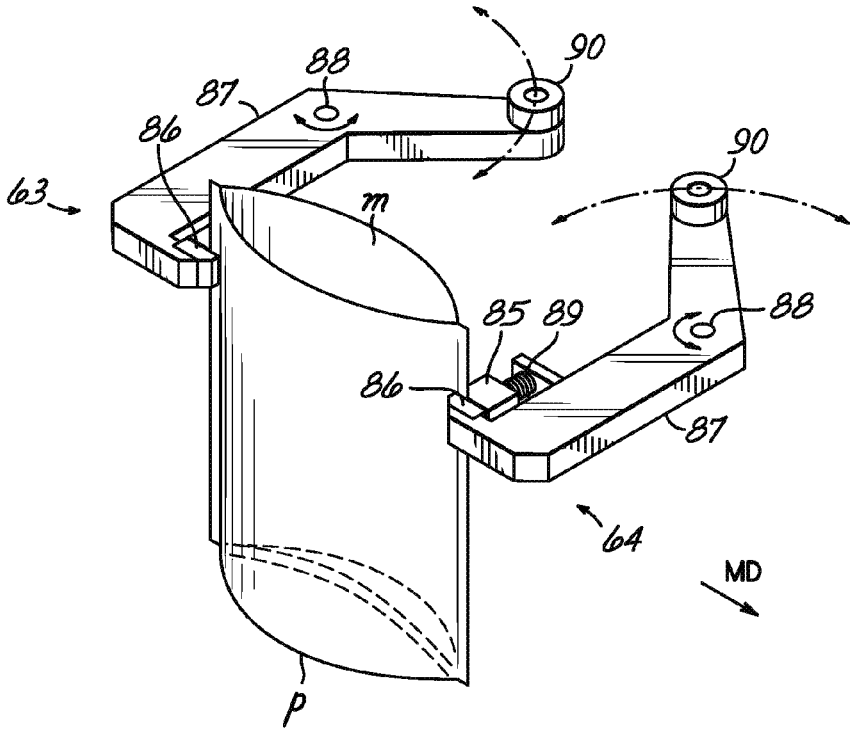
FIG. 9B is a perspective view illustrating the gripper jaws of the invention of FIGS. 1-9A.

FIG. 9A illustrates the structure and operation of the clamping elements of the jaws 63, 64. Each jaw clamping structure comprises an anvil 85, a movable clamp member 86, a spring 89 and a pivot arm 87 carrying the clamp member 86. A cam follower 90 is mounted on a distal end of arm 87 and is moved by a cam (not shown) to pivot about axis 88 to open or close jaws 63, 64 at the appropriate timing sequence. These respective jaw clamping parts are similar, with trailing jaw 64 being generally a mirror image of leading jaw 63 as viewed in FIG. 9A. Springs 89 are used to bias the respective clamping elements 86 toward the anvils 85. FIG. 9B illustrates the motion of jaws 64, 63 of FIG. 9A relative to each other to respectively open the mouth M on the pouch P for filling, and then to close the pouch mouth M.

Turning now to FIG. 10, an alternative form of gripper unit 74 is illustrated. In this unit, which is somewhat similar to the gripper unit 62 described above, the trailing jaw structure 76 is mounted on a slidable bracket 67, such as that bracket in the preceding embodiment, and is provided with a parallel link construction 75 with a pivot mounting on actuator arm 77 so that the trailing jaw 76 is always maintained in a parallel condition with respect to the pouch to be handled. Thus, as the actuator arm 77 is rotated about the pivot point 78, the jaw 76 remains essentially parallel to leading jaw 79 for engaging the pouch. In this regard, the leading jaw 79 is similar to that jaw 63 of the embodiment of FIG. 9. The clamping elements of jaws 76, 79 can be described above.

In the embodiments of FIGS. 9-10 inclusive, it will be appreciated the jaws 63, 64, 76,79 are mounted on or to filler wheel 18. It will also be appreciated that the clamping elements 85, 86 are mounted for rotation about vertical axes 88, perpendicular to filler wheel 18 or the horizontal plane in which filler wheel 18 rotates, with axes 88 parallel to a vertical axis about which horizontal filler wheel 18 rotates. This is contrasted to the motion of the trailing jaws 64, 76 mounted for rotation about axes 66, 78 respectively, which are perpendicular to the vertical axis about which filler wheel 18 rotates. Accordingly, the respective clamping elements of the jaws rotate about vertical axes while the jaw structure rotates about horizontal axes for pouch receiving, opening, closing and discharge.

Figure 17:
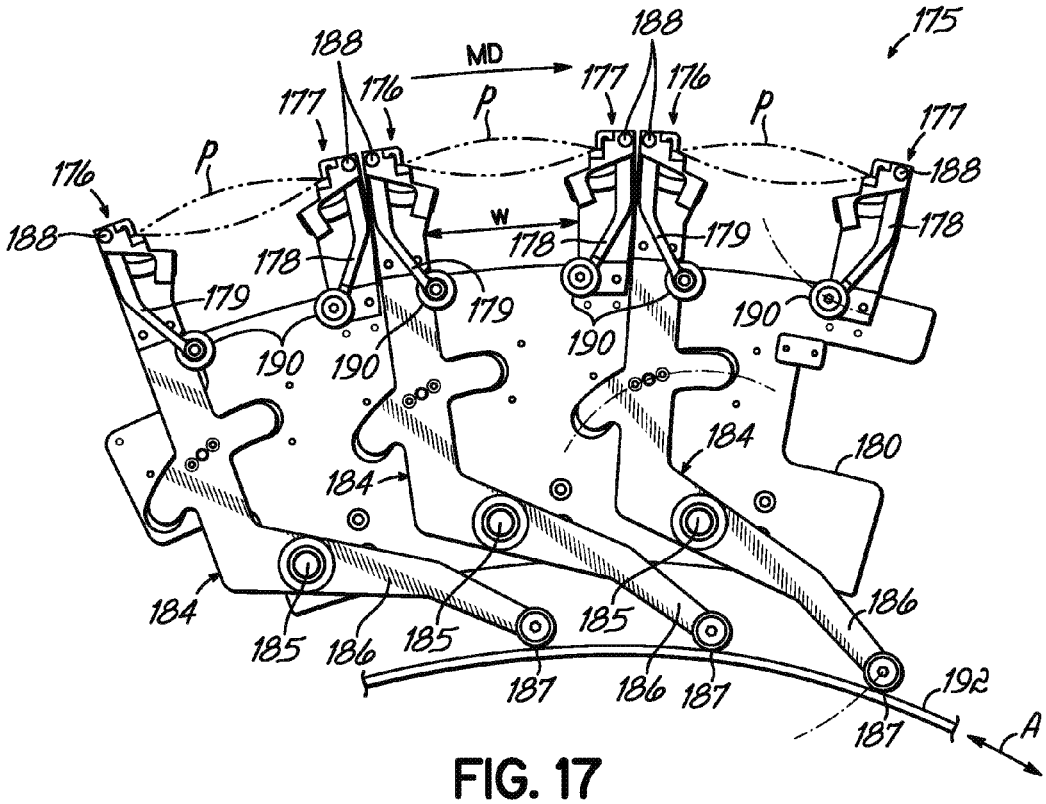
FIG. 17 is a bottom view of an alternative preferred gripper jaw embodiment of the invention with gripper jaws pivoted on vertical pivot axes perpendicular to the plane of rotation or surface of a filler wheel.
Figure 19:
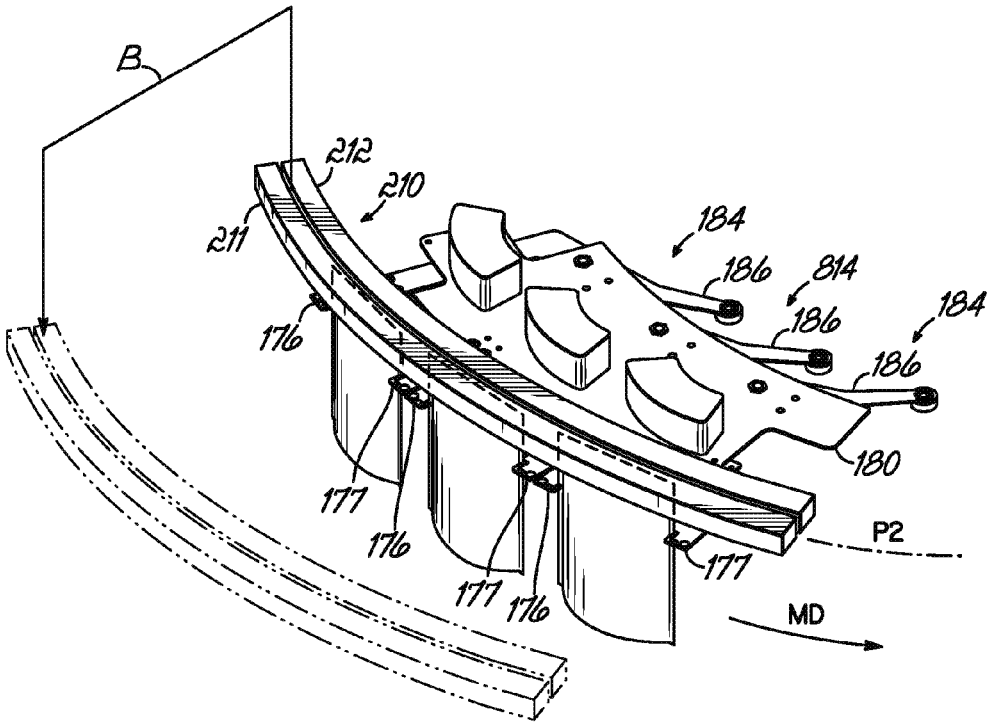
Figure 20:
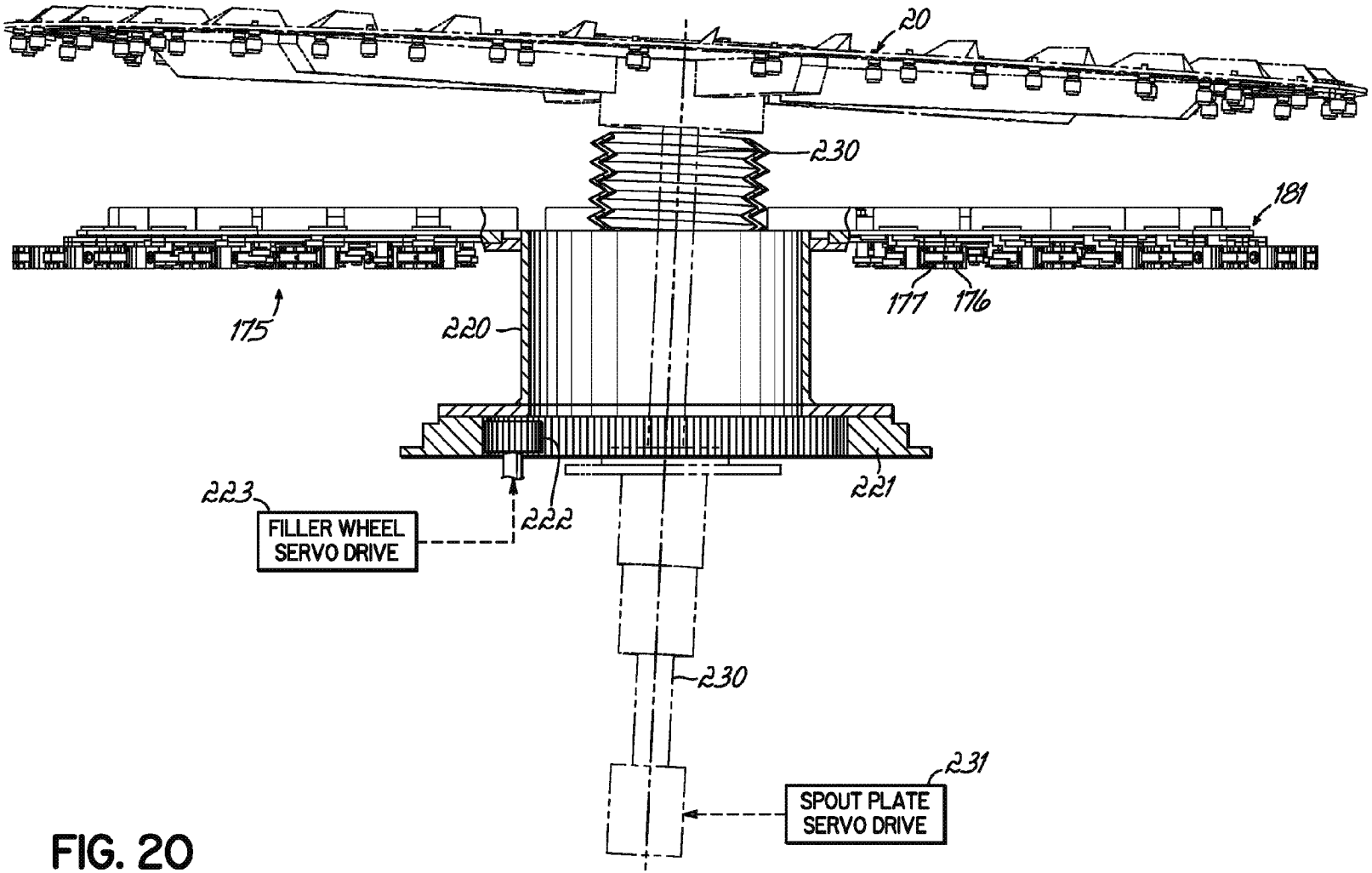
FIG. 20 is an elevational view of an alternate embodiment of the invention showing alternate gripper jaws of FIG. 17 mounted on a filler wheel, and the upper spout plate (with spouts removed for clarity) and illustrating the separate and independent servo drives for the filler wheel and spout plate, respectively.

A yet further jaw embodiment is illustrated in FIGS. 17, 19 and 20. in this preferred embodiment, comprising an alternative gripper unit 175, trailing jaw 176 and leading jaw 177 are used to clamp, handle and support a pouch P as do the respective leading and trailing jaws of the prior embodiments. As well, the clamping elements and anvils of the jaws are similar. This embodiment differs from the prior embodiment in several respects, including the rotational movement for both pouch clamping and for pouch receiving, opening, closing and discharge being about vertical axes, perpendicular to wheel 18, 181 and parallel to the vertical axis about which wheel 18, 181 rotates.

Accordingly, the pouch engaging elements of leading jaws 177 are supported on pivot arms 178 and those of the trailing jaws 176 on pivot arms 179, both arms operating pouch clamping elements and anvils as in the prior embodiments, and both rotatable about respective vertical axes 185, 188.

Cam followers 190 operate the spring loaded clamping elements about respective axes 188 to pinch or release pouch seams against respective anvils as in the other gripper embodiments.

Departing from that prior construction, however, lead jaws 177 are mounted to a component 180 of a filler wheel 181 (only segment 180 shown in FIG. 17). The trailing jaws 176 are mounted on another pivot arm 184, each pivoted at an axis 185 to segment 180 of a filler wheel 181. Axes 185 are disposed perpendicularly to filler wheel 181 or the plane in which it rotates, and parallel to a filler wheel axis. One end 186 of arm 184 carries a cam follower 187 driven by an appropriate cam 192 to adjust the relative position of trailing jaws 176 to cooperating lead jaws 177. This accommodates pouches of varying width "W" (FIG. 17), and provides a very thin jaw profile (in elevational view—see FIG. 20). It will be further appreciated this thin profile, as compared to the prior described jaw embodiments, is provided by mounting the trailing jaw structures to an arm provided on an axis 185 perpendicular to the filler wheel 181, so the overall structure of the jaw mounting element extends in a radial direction from an axis of rotation of filler wheel 181, rather than being vertically disposed in the periphery of the wheel as in the other embodiments.

Accordingly, one cam 192 is used to facilitate pouch edge gripping and another cam drives cam followers 187 to adjust the relative jaw position. Such a cam 192 can be advanced or retarded in the direction of arrow A and thus adjusted to accommodate a wide range of pouch widths W.

It will thus be appreciated that respective components of gripper units 62, 74 rotate about respective axes perpendicular to each other while components of gripper unit 175 rotate about respective axes parallel to each other.

With attention now to the adjustable operation of the filler and FIGS. 1-10, it will be appreciated that individual pouches P are introduced to a suitable gripper unit, such as 16, 62, 74 or 175, and is transported about a path defined by the filler wheel 18. In order to handle different sized pouches, that is pouches of different widths, and in the range of, for example, 2.5 to 5.5 inches in width, the gripper units on the filler wheel 18 are individually adjusted, as heretofore noted, so that the operable distances between the leading and trailing jaws, respectively, is adjusted to handle the particular pouch size.

In addition, the spout wheel 20 is provided with a plurality of removable snap-in spouts 22 and knife edges 82, which define the separation point between the respective spouts 22. When it is desired to change over from one pouch size to another, the pouches 22 are provided with snap-in connection to the wheel 20 and can easily be removed from the wheel 20 with new pouches 22 snapped in. New pouches 22 may be provided with slightly varied angles of approach, for example, to the discharge point for accurately depositing product in the new size of pouch. In addition, the knife edges 82 can also be provided with a snap-in construction, so that they can be changed when necessary, or the knife edges 82 can be retained in position.

In addition to this, it may or may not be necessary to phase the spout wheel 20 with respect to the filler wheel 18 so that the bottom discharge opening of the respective spouts to be used are accurately located with respect to the open mouths of the pouches on the filler wheel 18. Any appropriate structure, as is well known, can be utilized to transfer product into the spouts from above the spout wheel 20 for filling into the pouches. After the pouches are filled, the gripper units are preferably operated to stretch the mouths of the pouches together, so that they can be sealed in the top sealer unit 24.

Sealer unit 24, as noted, comprises reciprocal sealing jaws which can be oriented to seal the mouths of the pouches as they move through the respective jaws or sealer apparatus. The sealer apparatus is also mounted on reciprocal rods as indicated, for example, in the figures, including FIGS. 6 and 7, so that the movable jaws or elements of the sealer can be laterally moved away from each other and away from the mouth of the pouch when any stoppage, such as a cycle or emergency stop or shutdown of the equipment, is commanded, so as to prevent undue transfer of heat into the pouches, as would destroy them or render them unacceptable.

For discharge downstream of the filler wheel 18, such as shown, for example, in FIGS. 5-7, it will be appreciated that the pouches are engaged by the discharge wheel 28 and removed or released from the filler wheel 18 in a pouch discharge sector 56 discharging pouches from filler wheel 18 and from filler module 19. It is during this operation that the pouches are transferred from a vertical to a horizontal orientation for discharge.

It will also be appreciated that the speed of rotation of the wheel 28 and its alignment is coordinated with the speed of the filler wheel and the pitch line of the pouches on the filler wheel 18, so that the suction cups and pivot arms of the discharge wheel 18 are accurately lined with pouches as they come from the sealer to facilitate the discharge operation.

In connection with the introduction of separate pouches to the gripper units used, it will be appreciated that the knife 12 can be of any suitable construction. One form of knife includes two knife hubs, each with extending knife blades, as diagrammatically illustrated in the figures. These two knife hubs can be rotated at a speed, such that two of the blades come into shear orientation in the center of the seals which have been provided by the vertical sealer apparatus.

In order to adjust the knives to accommodate pouches of different widths, it is only necessary to adjust the speed of the two hubs so as to shear pouches from the web train presented to it in the appropriate distance, as will be appreciated. Thereafter, pouches are transferred to the filler wheel and the gripper units by means of a vacuum belt as is well known in the art.

In one embodiment, and as shown in the view of FIG. 6, the transfer, opening, filling, top sealing and discharge are carried out through varying sectors or arcs of a circular pouch path or pitch line defined in part by the filler wheel. Thus, in one embodiment, pouch transfer to the filler wheel occurs in a pouch transfer sector or arc of about 42 degrees. Pouch opening occurs in a sector of about 36 degrees. Pouch filling occurs in a sector of about 120 degrees, pouch closing and product settling occurs in a sector of about 61 degrees, hot air top sealing occurs in a sector of about 58 degrees, final roll crimping or sealing occurs in a sector of about 13 degrees and pouch discharge occurs in a sector of about 30 degrees. Filler wheel diameter and number of pouch stations are provided to accommodate the times required for these operations as the pouches move through the generally circular operational path at the desired throughput speed, the time each pouch traverses through an operational sector being sufficient for the effective operation performed in that sector at the throughput speeds desired, and for continuous operation. As an example, a filler wheel might provide 24 to 32 pouch stations. Other numbers of stations may be provided within these parameters.

Turning now to an alternative embodiment as shown in FIGS. 11-12, for example, it will be appreciated that in this embodiment, the pouches are not separated before they are filled, but rather are entrained about a filler wheel, filled, sealed and then cut off, one from another, as will be described.

In this embodiment, it is of course still necessary to provide transverse seals in a folded web pouch and to this end, a vertical sealer 10 can be provided in a sealer module 11 as disclosed in FIG. 1 with respect to the first embodiment described above. The vertical sealer 10 in the second embodiment shown in FIGS. 11-12 can be identical to that described above with respect to the first embodiment.

In the embodiment shown in FIGS. 11-12, a pouch forming, filling and sealing operation 100 is illustrated. This operation typically includes a pouch web sealer forming transverse seals in folded webs of the pouch, just as described above. The pouch web is then introduced to a filler wheel 106 carrying a plurality of seal supporting lands 101 mountable on wheel 106 and engaging the transverse seals between the pouches. These lands are preferably spaced at a chord length slightly less than the width of the pouch so that the mouths 102 of the pouches can be held opened as the pouches reside on the lands and as they are transported in the direction of the arrow 103 for filling, as product is transferred through a plurality of spouts 104 on the spout wheel 105 rotationally disposed above the filler wheel 106 carrying the lands 101.

Similarly to the prior embodiment, the spout wheel 105 is slightly tilted over the filler wheel 106 so that spouts can be positioned directly over the pouches with the lower discharge ends of the spouts in position for filling the pouches as the spout wheel turns with the filler wheel. After the pouches are filled, they are still disposed in a pouch train and transported to a sealer 108 operable to seal the top mouths of the pouches together. Thereafter, the pouches are transported through a crimping roller operation 110 and may be inverted to a horizontal form through feed rollers 111 in direction of arrow 112 to a knife 114 where individual pouches P-1 are cut and discharged from the operation.

The actual opening, filling, closing and sealing of the pouches as illustrated in FIG. 11 in this embodiment is similar to prior pouch train filling devices. It will be appreciated, however, that accommodation is made in the filler area to handle pouches in a wide range. Features of a pouch width adjustable filler wheel 106 are illustrated in exploded form in FIG. 12.

In FIG. 12, there is shown a vacuum shoe or turret 116, the filer wheel 106, and the spout wheel 105 carrying a plurality of spouts 104. The turret 116, filler wheel 106 and spout wheel 105 are operably interconnected together in operation to perform the filling process.

It will be appreciated, however, that the lands 101 are provided in the filler wheel 106 by means of respective mounting areas such as slots 117, for example. In order to facilitate change of the filler operation from one size pouch to another, a plurality of filler wheels 106 can be provided with heated lands 101. It will be appreciated that each filler wheel 106 is provided with a plurality of vacuum passages 118 interconnected with appropriately disposed vacuum passages in the heated lands 101 for providing vacuum to the ports 119 in the heated lands 101.

Each of the vacuum passages 118 has a lower port 120 and each of these ports for the respective filler wheel 106 are located at a set radial distance outwardly from the axis of rotation 122 of the filler wheel and spout wheel.

The vacuum turret 116 is provided with a plurality of vacuum ports and sets, such as vacuum ports 123 in one set, vacuum ports 124 in another set, and vacuum ports 125 in another set. Each of the sets of vacuum ports 123, 124, 125 is disposed at a different radial distance from the center axis 122 of the turret 116.

Accordingly, when the filler wheel 106 is disposed on the vacuum turret or shoe 116, and rotated, the ports 120 of the filler wheel are operatively associated with the ports at 123 on the vacuum shoe as the filler wheel 106 is turned. When the filler wheel 106 is changed out for another filler wheel which, for example, has vacuum lands 101 set at a different radial distance from the axis 122, that filler wheel has a set of ports which communicates with port set 124 or 125, for example, in the vacuum shoe 116. By this means, the filler can be changed out to handle different pouch sizes by simply providing a plurality of filler wheels 106, each with a set of vacuum lands, but the vacuum lands having outer surfaces spaced at different radial distances from the center 122 so that the chords or distances between the effective surfaces of the vacuum lands on the different filler wheels are positioned to handle a particular pouch width.

Accordingly, it will be appreciated that a variety of change out structures can be provided in this embodiment. For example, a plurality of filler wheels, each with a set of lands spaced at different radial distances than the lands of other filler wheels could be provided.

Alternately, a single donut-shaped ring or wheel, such as illustrated at 106 in FIG. 12, could be provided, and a plurality of vacuum lands could be adjusted in a radial direction within slots 117 to extend at different radial distances from the donut or wheel 106, thereby only requiring a single set of vacuum lands, each with its own vacuum ports, for interacting with the specific vacuum port sets of the vacuum turret 116 determined by radial adjustment of the lands. Further, varied sets of vacuum lands could be removably mounted on a single donut or ring to provide changeout.

In this regard, on change out, the spout wheel 105 carries a plurality of changeable spouts 104 which can be snapped in or out, depending on the particular spout configuration needed to handle the particular pouch width selected. Alternately, a plurality of spout plates, each with its own set of spouts, could be provided for cooperating with the particular filler wheel selected for the pouch width to be filled.

Once the pouches are filled and sealed as shown in FIG. 11, they are transported to the knife 114 for cutting the pouches. In the past, pouch cut off knives have been provided with slight degrees of adjustability, so that the package guides associated with the knives can be adjusted radially inwardly and outwardly to accommodate slight variations in the seal to seal distances defining each of the filled pouches. The adjustments provided as noted above have been accomplished in the past by means of screw operated cones maneuvering pouch guide mounting structures. Change out of knife hubs of different sizes requires change in the distance between the otherwise fixed axes on which the major and minor hubs rotate and is thus a problem.

In this embodiment, it is desired to provide an improved knife with plural hub sets which can be changed out to handle pouches in different widths by the mechanism of simply changing the major and minor knife hubs. Two or more knife hub sets can be provided to handle pouches of varying width or at varying pitch from one operation to another with a simple hub set change from one hub set to another. This is accomplished by a four gear drive train described below which accommodates variation in the space or distance between major and minor hub drive axes requires for hub set change. Such an overall knife 114 according to the invention is shown in FIGS. 13 and 14 and additional features thereof in FIGS. 15 and 16.

Figure 13:
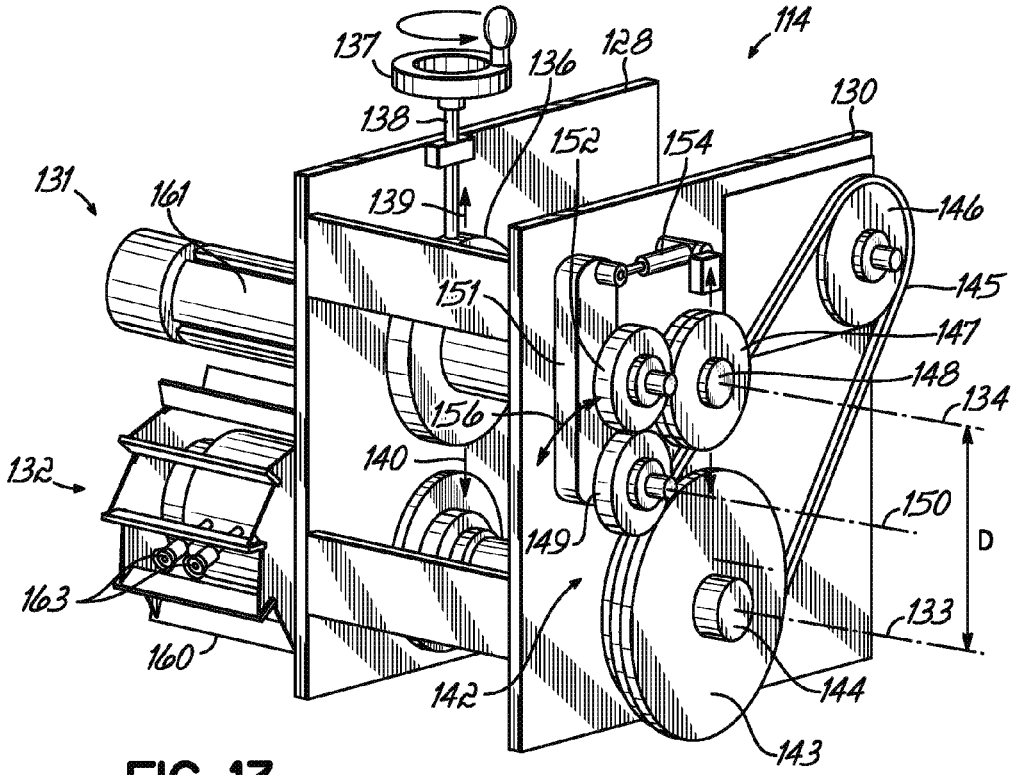
FIG. 13 is an illustrative perspective view of a changeable rotary knife and knife drive according to the invention.
Figure 14:
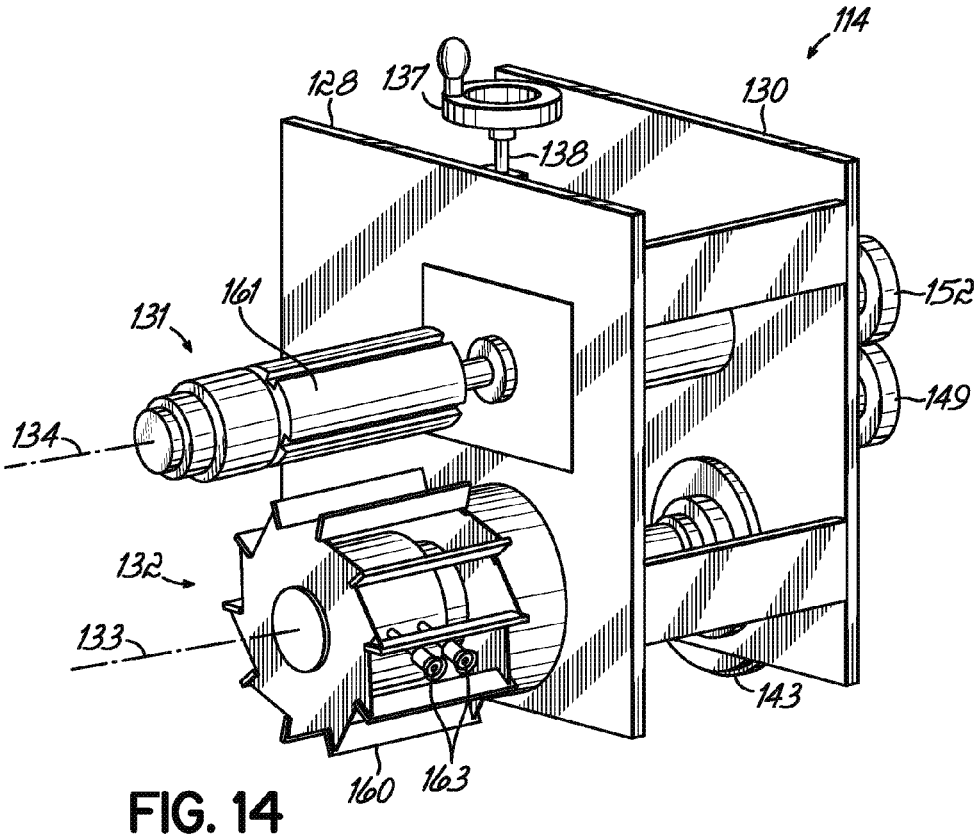
FIG. 14 is an illustrative perspective view of the rotary knife of FIG. 13 viewed from the knife hub side.

FIGS. 13 and 14 show the knife 114 from opposite sides. The knife may comprise a knife module defined, in part, by two mounting plates 128 and 130. A minor knife hub 131 and a major knife hub 132 are mountable outside the plate 128 on respective bearings. For example, the major hub 132 is mounted on a major hub drive axis 133, while the minor knife hub 131 is mounted on a minor hub drive axis 134. Major knife hub 132 is preferably mounted on fixed bearings in the plates 128, 130. On the other hand, minor knife hub 131 is mounted on an axis journaled in movable bearings. For example, a bearing is disposed in a bell housing 136 which can be adjusted by means of the wheel 137 having a shaft 138 attached to the bell housing 136.

When the bell housing, which can be belted to plate 128, is loosened, rotation of the wheel 137 in shaft 138 can move the bell housing 136 in a vertical direction, such as shown by the arrows 139, 140. Similar provisions can be made to loosen the bearing journal for the minor knife hub shaft in plate 130, if such journal is desired. Thus, the minor hub drive shaft can be moved toward or away from the major hub drive shaft to accommodate hub set change.

It will be appreciated that, upon change out for different pouch web sizes, different major and minor knife hubs are changed out and provided on the axes 133 and 134, respectively. In this regard, it will be appreciated that the effective cutting diameters of the cooperating knife hub sets are different.

The differences in diameters of the respective knife hub sets used on change out will, by necessity, vary the distance D between the drive axes 133 and 134 by the above described structure. In order to accommodate differential positions of the axis 134 with respect to the fixed axis 133, the drive must also be variable as relative movement of the drive axes 133, 134 requires a resulting accommodation of the drive. There is thus provided according to the invention a four gear anti-lash gear drive train 142 as best seen in FIG. 13, and showing four gears in a gear linkage comprising the four gear drive train.

Accordingly, it will be appreciated that a first drive gear 143 is secured to the major knife hub shaft 144 for rotating the knife hub 132, such as through a belt 145 driven by a drive pulley 146.

It will also be appreciated that a slave gear 147 is secured to the drive shaft 148 for the minor knife hub 131 on axis 134. A first anti-lash gear 149 is mounted on a fixed axis 150, about which a pivot arm 151 is also mounted. A second anti-lash gear 152 is rotationally pivoted to the arm 151. The axis of the gear 152 and thus movable gear 152 can be moved circumferentially around the fixed axis 150, movable gear 152 accommodating changes in the spacing of axes 133, 134.

An adjustment arm or actuator 154 is attached between the top of pivot arm 151 and plate 130, for example, so that when the pivot arm is loosened, the adjustment arm 154 can be rotated or operated to adjust the angular disposition of the pivot arm 151 about the axis 150.

It will be appreciated that when the pivot arm is moved away from the axis 134, for example, in the direction to the left of the arrow 156, the one anti-lash gear 152 is moved away from but is re-engageable with the slave gear 147. This allows the slave gear to be moved upwardly and downwardly as the shaft 148 is moved upwardly and downwardly upon rotation of the wheel 137 and movement of the bell housing 136, or in other words, as the distance D between axes 133, 134 is changed to accommodate substitution of one hub set for another.

Once the major and minor knife hubs are changed out, the bell housing is positioned for appropriate interaction and cooperation between the minor and major knife hubs and the bell housing and any bearing journals for the shaft 148 are fixed. Thereafter, the adjustment arm 154 is operated to move the pivot arm in the opposite direction of the arrow 156 to re-engage the anti-lash gear 152 with the slave gear 147 and re-establish an effective drive train and rotational drive between the drive gear 143 and the slave gear 147. Thus, gear 152 is moved for disengaging, then re-engaging gear 147.

In this way, variations in the effective operational diameters of the minor and major knife hubs and the changes in the distance D between the axes 133 and 134 resulting therefrom are accommodated.

From the illustrations in FIGS. 13 and 14, it will be appreciated that the major knife hubs 132 include a plurality of extendible package guides 160 with fixed shear edges, which cooperate with the extending knife edges or blades 161 of the minor knife hub 131, so that as the two hubs are respectively rotated, the filled pouch web extending therebetween are cut off, one pouch from the other, in the sealer between the pouches.

As in the past, vacuum cups 163 are provided to hold the pouches on the knife until they are discharged, generally at the bottom of the major knife hubs 132.

Figure 15:
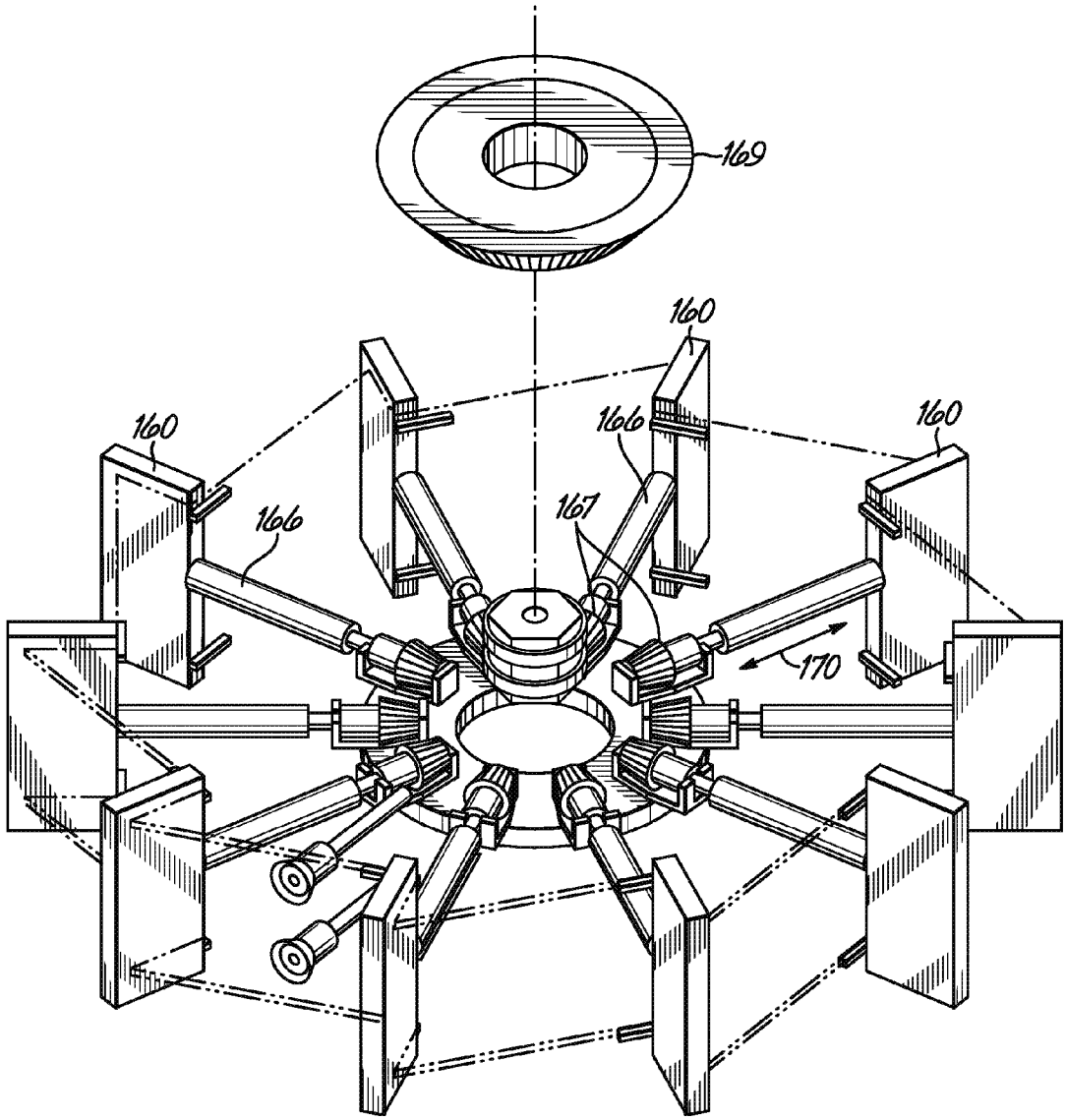
FIG. 15 is an illustrative view of the adjustable pouch guides of the major hub of the knife of FIGS. 13 and 14.
Figure 16:
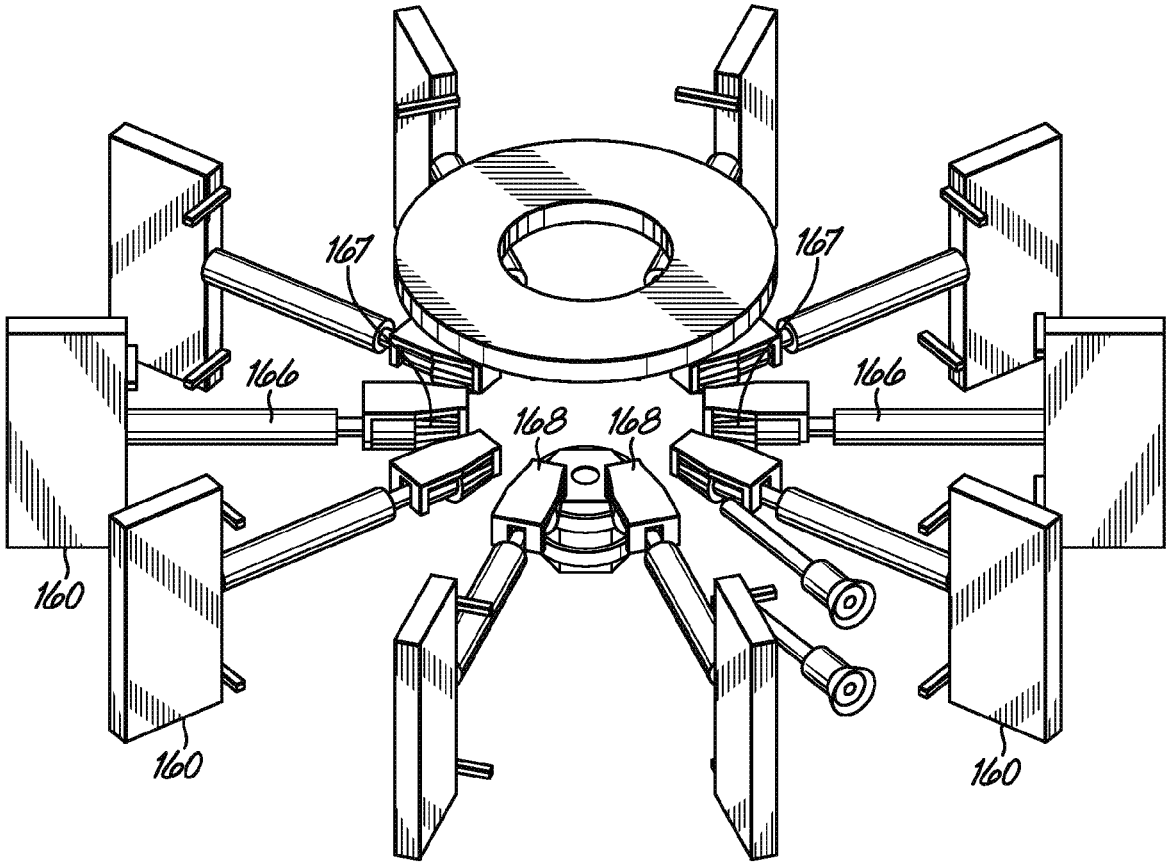
FIG. 16 is an illustrative view of the pouch guides of FIG. 15 but viewed from the opposite side of FIG. 15.

According to the invention, the package guides can be adjusted to accommodate slight variations in the positioning of the web seals between the filled pouches. Such an improved mechanism is illustrated in FIGS. 15 and 16. The package guides 160 are each mounted on a selectively reciprocating package guide support arm 166. Each support arm 166 is reciprocally mounted and has, at its bottom end, a beveled pinion gear 167 mounted for rotation on the knife structure, such as in brackets 168 as shown in FIG. 16, so that rotation of the gear 167 selectively drives and extends or retracts the guide.

A beveled ring gear 169 is applied in meshing engagement to the beveled pinion gears 167 such as, for example, to the exposed portions of those gears shown in FIG. 15. Beveled ring gear 169 can be phased with respect to the extendible package guide supports so that relative rotation between the ring gear 169 with respect to the brackets 168 serve to turn the beveled pinion gears 167. That turning of those beveled pinion gears 167 extends or retracts the arms 166 in the direction of arrows 170 in order to adjust the extension and retraction of the package guides 160. Thus, the guides are extendible responsive to rotation of the gears 167, 169.

This variation or adjustment can be used to change the chord lengths between the package guides to accommodate slight variations of sealer orientation in the pouch web which is being cut.

Accordingly, by change out of major and minor knife hubs at varying operable diameters to accommodate a wide range of pouches, and by provision of easily adjustable package guides 160, a wide range of pouches can be handled in the knife, including pouches having widths ranging from 2.5 to 5.5 inches, for example.

The invention also contemplates three other alternative embodiments as will now be described.

Figure 18:
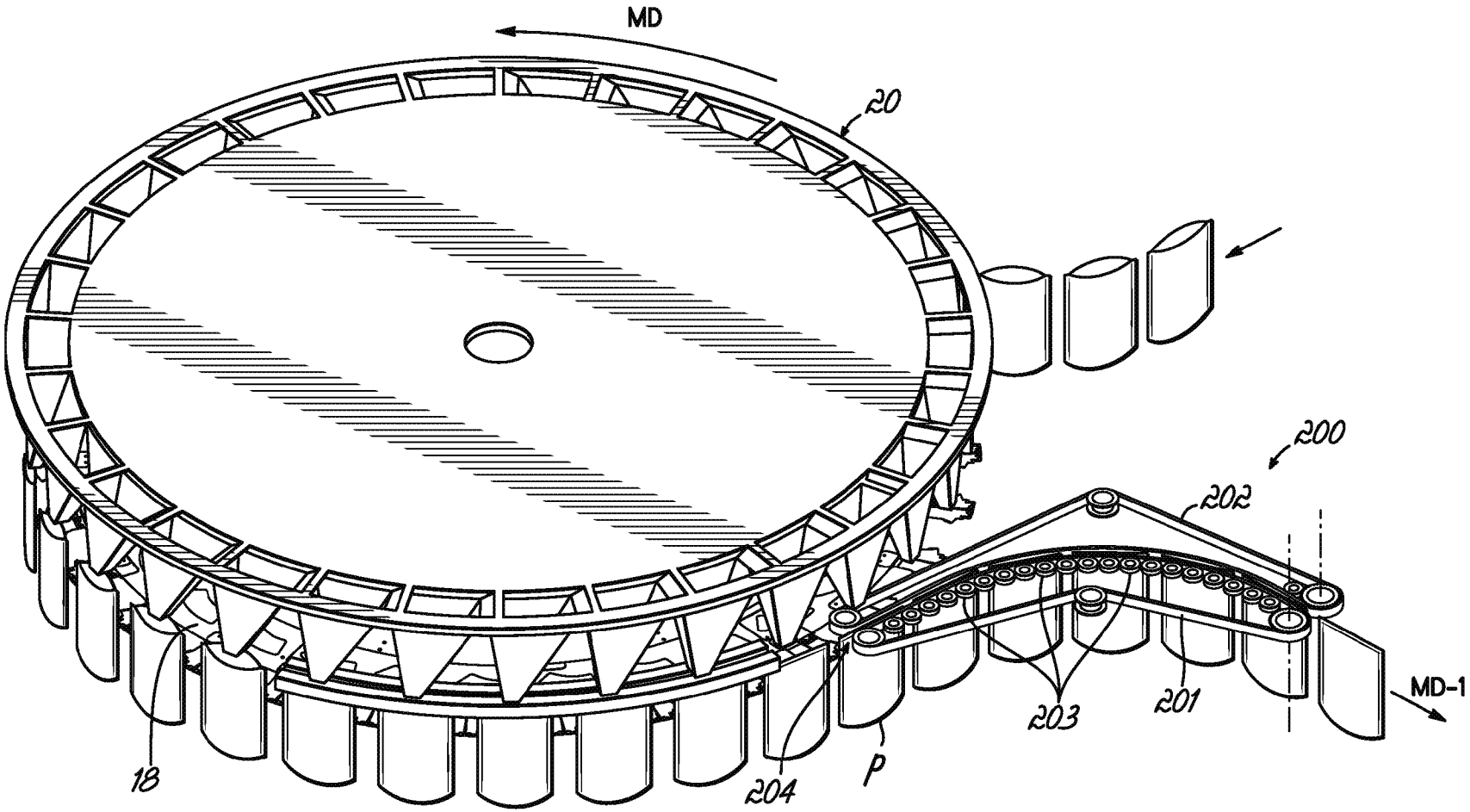
FIG. 18 is a perspective view of an alternate pinch-belt pouch discharge from a filler according to the invention.

In one embodiment, shown in FIG. 18, the discharge wheel 28 is deleted and a pinch belt discharge module or structure 200 is substituted. In this embodiment, the pouch web is formed by any suitable means and the pouches are cut, filled and sealed as described with respect to FIGS. 1-10. After sealing and any top or mouth crimping, the pouches are retained on filler wheel 18 within their path of travel defined by a pitch line of circular or curved orientation until they reach a pouch discharge sector illustrated in FIG. 6. As the pouches enter this sector, they are held by the gripper units used at their leading and trailing side seams and just below the sealed top edges or top portion of the pouch.

The pinch belt structure 200 includes two opposed pinch belts 201, 202 defining a pouch oriented in part in a curved orientation. The belts provide between them a pouch top pinch run 204 defined by a set of roller guides 203. This run is aligned with and preferably has an entry portion tangent to the curved pouch pitch line in which pouches are transported on filler wheel 18.

As the separate pouches P approach the pinch run 204, the leading end of upper edge or edges of the pouch top is engaged by the two opposed belts 201, 202 and the clamping components of the leading gripper jaw (below the pouch top) are opened to release the leading pouch edge from the gripper unit used, and the wheel 18, thus introducing it to the discharge module 200. Continued forward motion of the pouch results in more of the pouch top portion being captured between the belts 201, 202. The clamping components of the trailing jaw of the gripper is opened then, sequentially to that of the leading jaw, to release the trailing edge of the pouch top portion to the pinch belts.

From there, the pouches P are discharged in the direction MD-1 for further handling or packaging. As well, the trailing gripper jaw is moved by a cam to a proper position relative to its associated leading jaw for picking up the trailing edge of a new, empty pouch from the knife 12 in the pouch transfer sector.

In another aspect of the invention, illustrated in FIG. 19, a sealer 210 comprises hot air or electrical sealing platens 211, 212 disposed operationally on opposite sides of pitch line P2 (FIG. 19). These platens are movably carried by any appropriate frame structure mounted for vertical and horizontal or lateral movement, such as by air or hydraulic cylinders, or electric solenoids. Accordingly, platens 211, 212 can be moved vertically upwardly from pitch line P2 to clear any pouch material, then horizontally or laterally and then downwardly, all as shown by arrow B, to space the heated platens from the pouches. This prevents undue heat propagation into the pouch material or cycle or emergency or other stops. Any suitable framework and mover components can be utilized to so move the platens and they can be mounted to move respectively to each other for clearing, then repositioning operationally on startup with respect to the pouches at the sealing stations.

Such a sealer 210 can be used with any of the embodiments described herein.

In yet another aspect of the invention, an alternative drive apparatus is contemplated. For given ranges of pouch sizes, this alternative drive can provide for pouch width accommodation without the need to change out any spout wheel or the spouts thereon.

Such an embodiment is shown in FIG. 20 and contemplates the use of separate servo drives for each of the filler wheels 18 and 181 on one hand and the spout plates 20 on the other hand. In this regard, a filler wheel 18 or wheel 181 is carried on a hub 220 provided with a drive ring or gear 221 engagable by a drive pinion 222 on a drive shaft driven by a first servo drive 223.

Spout wheel 20 is connected to a rotatable drive shaft 230 extending through hub 220. Shaft 230 is driven by a separate and independent second servo drive 231 and is rotatable independently of hub 220. Spout plate 20 and filler wheel 181 are thus independently driven by separate servo drives, independent of each other.

Servo drives 223, 231 are electrically controlled so that spout wheel 20 and filler wheel 18 or 181 can be driven at the same speed, but also can be adjusted in rotational phase with respect to each other to accommodate variations of pouch width.

In this regard, it will be appreciated that the pouches are held on wheel 18 by gripper units having leading and trailing jaws. Lead jaws are fixed in circumferential position on wheel 18 or 181 while the trailing jaws are movable with respect to the leading jaws.

Accordingly, the position of the center of one pouch on the circumference and pitch line between its leading and trailing edge is different from the position of the center on the circumferential or pitch line of another pouch of varied size. For example, the vertical center line of a narrower pouch is closer to its leading edge, fixed on the wheel 18 or 181, than is the vertical center line of a wider pouch which is slightly retarded along the pitch line.

Optimally, it is desirable to align the bottom discharge port of a spout with the center line of the pouch. Accordingly, by adjusting the phase of the spout plate 20 with respect to the filler wheel 18 or 181 when pouch widths change, then running them at the same speed, the spouts are moved to proper alignment with pouches within the design range of pouch widths. The same spouts are sized and configured to discharge product into pouches throughout the pouch width range.

Change out for different pouch sizes is thus accommodated by a simple phase adjustment, accomplished through independent servo control, without requiring spout wheel or spout changeover to additional parts.

Such independent servo drives may also be applied to the filler embodiment of FIGS. 11-12, for example, where a phase adjustment as described may render change parts unnecessary for desired pouch width changes.

Accordingly, the invention contemplates several embodiments and variations for accommodating forming, filling and sealing pouches in a wide range of pouch widths, particularly including but not limited to 2.5 to 5.5 inches wide, and at relatively high pouch speeds through the system of up to approximately 500 pouches per minute. Change out for pouch size variation within a design range is facilitated with either no charge parts or minimal change parts as described.

While the embodiments disclosed have one application for a wide range of pouch widths, such as 2.5 inches to 5.5 inches, the invention can be sized to handle pouches of even larger widths such as 6, 8 or 10 inches or even larger, with size changes to the components described as necessary with the desired pouch size, and with a variety of ranges of such larger pouch sizes.

Also, the various modules described herein can be used in various configurations, or independently of the other. For example, the vertical sealer module 11 could be utilized to provide a transversely sealed multiple pouch web with open top pouches in sequential train for a variety of fillers, or for stock storage. The filler module 19 and the filler of FIG. 11 could be used independently of the vertical sealer module 11. The knife module 13 of FIG. 1 could be separated from the filler module 19, with cut pouches being stored, provided to a pouch magazine, or fed by other means to a filler handling cut-off, as opposed to entrained, pouches. The knife embodiments 114 of FIG. 11 and of FIGS. 13-16 can be used with filling and sealing apparatus or modules as described herein or with other filling or sealing apparatus.

Finally, it will be appreciated that the gripper units described herein are mounted on, mounted directly to, or are carried by the filler wheel, as opposed to being mounted on, mounted to or carried by chains in a path for filling.

It will be appreciated that combinations of the embodiments, elements and variations described herein can be made without departing from the scope of the invention and the description of one embodiment of the invention does not limit the use of the other described elements, components or variations herein consistent with their compatibility.

These and other modifications and variations of the invention will be readily appreciated by the foregoing to those of ordinary skill in the art without departing from the scope of the invention and applicant intends to be bound only by the claims appended hereto.

What is claimed is:

1. A method for continuously filling pouches while said pouches are moving, said method comprising the steps of:

sequentially and continuously introducing separate, discrete pouches, independent one from the other, each having leading and trailing sides and an unsealed top side defining a pouch mouth, into respective sets of moving pouch grippers carried on a continuously rotating filler wheel and while said sets are moving in a circular path, each set having a leading and trailing gripper, gripping respective leading and trailing sides of a discrete pouch;

continuously moving said discrete pouches in said circular path;

opening a mouth of each discrete pouch by relatively moving at least one of said leading and trailing grippers in one direction toward the other, to move leading and trailing pouch sides proximate the pouch mouth relatively toward each other, while said discrete pouches are moving in said circular path;

filling said discrete pouches through said open pouch mouths while said discrete pouches are moving in said circular path;

closing said pouch mouths by relatively moving at least one of said respective leading and trailing grippers in a second direction opposite said one direction and pulling respective leading and trailing pouch sides proximate said mouths relatively away from each other and while said discrete pouches are moving in said circular path;

sealing said pouch mouths closed while said discrete pouches are moving in said circular path; and discharging discrete pouches from said gripper sets and said wheel.

2. A method as in claim 1 including:

feeding said pouches through respective spouts mounted on a spout wheel while:

driving said spout wheel and said filling wheel independently of each other.

3. A method as in claim 2 including driving each of said wheels continuously and independently of each other through separate servo drives.

4. A method as in claim 3 including the step of adjusting the angular phase orientation of said wheels with respect to each other to accommodate varying pouch sizes.

5. A method as in claim 1 including the step of:

receiving and gripping said discrete pouches in a pouch transfer sector of rotation of said filling wheel;

opening said discrete pouches held by said grippers in a pouch opening sector of rotation of said filling wheel;

filling open discrete pouches held by said grippers in a pouch filling sector of rotation of said filling wheel; and closing said open discrete pouches held by said grippers in a pouch closing sector of rotation of said filling wheel, all while continuously rotating said filling wheel.

6. A method as in claim 5 including the further step of:

sealing closed and filled discrete pouches held by said grippers in a pouch sealing sector of rotation of said filling wheel; and thereafter discharging separate filled sealed pouches from respective grippers and said filling wheel;

all while continuously rotating said filling wheel.

7. A method as in claim 5 including the step of camming said grippers on said filling wheel as said filling wheel rotates for gripping, opening and closing said discrete pouches respectively.

8. A method as in claim 1 wherein said feed step includes:

delivering a discrete pouch separate from other discrete pouches to a pair of grippers and camming said grippers to hold said discrete pouch and then open said discrete pouch for filling by moving said grippers to move respective edges of said discrete pouch toward one another and opening a pouch mouth therebetween as said discrete pouch is continuously carried in a circular path about said filling wheel.

9. A method as in claim 8 including the step of closing said discrete pouches after said filling step by moving said grippers to move respective edges of said discrete pouch away from each other and closing said pouch mouth as said discrete pouch is continuously carried in a circular path about said filling wheel.

10. A method as in claim 1 wherein said step of opening a mouth of each discrete pouch includes the step of flowing air into said discrete pouches while said pouches are moving in said circular path.

11. A method for continuously filling pouches with product, said method comprising the steps of:

feeding discrete pouches to a filling wheel including feeding individual pouches to respective pouch grippers mounted on said wheel and while said wheel is rotating with said grippers moving in a circular path;

feeding said pouches, from above said path, with product through respective spouts mounted on a spout wheel, while driving said spout wheel and said filling wheel independently of each other.

12. A method for continuously forming filled pouches, having leading and trailing sides and an open mouth between said sides, with product and comprising the steps of:

introducing separate and discrete pouches sequentially and continuously to respective sets of moving pouch grippers carried on a continuously rotating filler wheel and moving in a circular path upon rotation of said wheel, each respective set of grippers gripping pouch sides between said grippers while said grippers are moving; and continuously moving said discrete pouches in said circular path while gripped by said grippers and while opening, filling, closing and sealing them.

13. A method as in claim 12 wherein said respective openings and closing steps include pushing at least one respective pouch side toward another side of that discrete pouch to open said mouth before filling and then after filling, pulling said pouch sides relatively apart to close said mouth for sealing while discrete pouches are moving in said circular path.

* * * * *